US008813669B2

(12) United States Patent
Race et al.

(10) Patent No.: US 8,813,669 B2
(45) Date of Patent: Aug. 26, 2014

(54) TOWED ANTENNA SYSTEM AND METHOD

(75) Inventors: Roger E. Race, South Dartmouth, MA (US); Jacob C. Piskura, Fall River, MA (US); David S. Sanford, Marion, MA (US)

(73) Assignee: Rolls-Royce Marine North America, Inc., Walpole, MA (US)

( * ) Notice: Subject to any disclaimer, the term of this patent is extended or adjusted under 35 U.S.C. 154(b) by 278 days.

(21) Appl. No.: 12/797,545

(22) Filed: Jun. 9, 2010

(65) Prior Publication Data

US 2011/0162573 A1 Jul. 7, 2011

Related U.S. Application Data

(60) Provisional application No. 61/268,439, filed on Jun. 12, 2009.

(51) Int. Cl.
*B63G 8/00* (2006.01)

(52) U.S. Cl.
USPC ..... 114/244

(58) Field of Classification Search
CPC ..... H01Q 1/04; H01Q 1/30; H01Q 1/34
USPC ..... 114/326, 328, 244, 253, 245, 246; 343/709; 340/850
See application file for complete search history.

(56) References Cited

U.S. PATENT DOCUMENTS

| | | | | |
|---|---|---|---|---|
| 1,944,891 | A | 1/1934 | Hill | |
| 2,858,085 | A * | 10/1958 | Strang | 242/390.6 |
| 3,034,471 | A * | 5/1962 | Aschinger | 114/244 |
| 3,961,589 | A | 6/1976 | Lombardi | |
| 3,972,046 | A * | 7/1976 | Lombardi | 343/709 |
| 4,227,479 | A * | 10/1980 | Gertler et al. | 114/312 |
| 4,543,582 | A | 9/1985 | Hellwege et al. | |
| 5,132,696 | A | 7/1992 | Cobb | |
| 5,379,034 | A | 1/1995 | O'Connell | |
| 5,964,175 | A | 10/1999 | Sirmalis et al. | |
| 5,977,918 | A * | 11/1999 | Sirmalis | 343/709 |
| 6,845,728 | B1 | 1/2005 | Horton | |
| 6,883,452 | B1 | 4/2005 | Gieseke | |
| 6,904,341 | B2 | 6/2005 | Kish et al. | |
| 7,252,046 | B1 | 8/2007 | Ead et al. | |
| 2003/0024453 | A1 | 2/2003 | Fonda | |
| 2003/0167997 | A1 | 9/2003 | Colyer | |
| 2007/0123122 | A1 | 5/2007 | Puzella et al. | |
| 2008/0041294 | A1 * | 2/2008 | Diorio et al. | 114/312 |

FOREIGN PATENT DOCUMENTS

| | | |
|---|---|---|
| EP | 1 270 400 | 1/2003 |

OTHER PUBLICATIONS

International Search Report and Written Opinion dated Aug. 18, 2010 in connection with PCT Patent Application No. PCT/US10/38042 (11 pages).

(Continued)

*Primary Examiner* — Edwin Swinehart
(74) *Attorney, Agent, or Firm* — Krieg DeVault LLP

(57) ABSTRACT

A towable antenna system is deployable and retrievable from and tetherable to an underwater vehicle while the underwater vehicle is submerged under water. An underwater vehicle having a towable antenna system is capable of communicating with one or more remote communication systems, the towable antenna system acting as an intermediary for communications between a submerged underwater vehicle and the one or more remote communication systems.

42 Claims, 16 Drawing Sheets

(56) References Cited

OTHER PUBLICATIONS

Printout of Webpage dated Aug. 10, 2010 from http://www.sippican.com/contentmgr/showdetails.php/id/314 (3 pages).

English language machine translation for EP 1 270 400 A2, Jan. 2, 2003.

Extended European Search Report, Rolls-Royce Naval Marine, Inc., EP 10786810.1, Oct. 2, 2012.

* cited by examiner 60
66
84
64
62
68
65
70
48
42
44
50
54
48
46

5

66
40
60
84
64
42
54
50
54
48
46
5

TOWED ANTENNA SYSTEM AND METHOD

CROSS-REFERENCE TO RELATED APPLICATION

This application claims priority from U.S. Provisional Patent Application Ser. No. 61/268,439, filed Jun. 12, 2009, which is incorporated herein in its entirety by reference.

GOVERNMENT LICENSE RIGHTS

The U.S. Government has a paid-up license in this invention and the right in limited circumstances to require the patent owner to license others on reasonable terms as provided for by the terms of Contract No. N00014-09-M0038 awarded by the U.S. Department of Defense.

BACKGROUND OF THE INVENTION

This application relates generally to towed antenna systems and methods, and more particularly to systems and methods for communicating data signals to and from underwater craft to and from one or more remote communication systems.

When any underwater vehicle (UV), such as, for example, an unmanned underwater vehicle (UUV) or a submarine, is submerged under water, it cannot receive a GPS signal from a GPS satellite, and it cannot transmit or receive data signals over the air using radio frequency (RF) or satellite communication techniques. This lack of connectivity to the world above the surface of the water when submerged may significantly impact or constrain UV operations, and ultimately, the mission the UV may perform. Consequently, the ability to transmit and receive data signals may be beneficial to UV operations while a UV is submerged.

Unmanned underwater vehicles (UUVs), which are also known as autonomous underwater vehicles (AUVs), have been in use for some time. In particular, UUVs are known to be used to carry out missions involving intelligence, surveillance, and reconnaissance (ISR), mine countermeasures (MCM), anti-submarine warfare (ASW), time critical strike (TCS), inspection and identification, oceanography, oil and gas, payload delivery, and information operations, to name a few. UUVs are autonomous in the sense that, once launched on a mission, they operate according to a preprogrammed mission profile.

UUVs are also known to be formed from a series of interchangeable segments to permit flexibility in adding, subtracting or replacing entire hull segments of the UUV to tailor the UUV to a particular mission. UUVs are further known to have standardized hull diameters of, for example, 9 inches, 12¾ inches, and 21 inches. However, deployable and retrievable towable antenna systems configured for use in connection with a submerged UUV and which are capable of receiving GPS signals and transmitting and receiving RF (e.g., Wi-Fi, cellular, spread spectrum, etc.) and satellite data signals to and from the UUV and to and from aircraft (e.g., fixed wing manned and unmanned aircraft (including unmanned aerial vehicles and unmanned combat vehicles), cruise missiles, helicopters, and lighter than air craft such as balloons, etc.), spacecraft, watercraft (e.g., ships, boats, hovercraft, pontoons, buoys, beacons, and relays, etc.), and terrestrial locations are not known to exist aside from the instant disclosure.

Consequently, a towable antenna system of the type herein disclosed, which may be deployable and retrievable from and tethered to a UUV while the UUV is submerged, and which bi-directionally (i.e., transmit and receive simultaneously or sequentially in packets or without packets) communicates to and from the UUV and to and from, for example, air, space, and terrestrial communication systems via, for example, RF and satellite communication systems, as well as have the ability to receive GPS signals via GPS communication systems, may greatly enhance UUV operability and flexibility by permitting the UUV to remain submersed for longer periods than currently known UUV systems. In addition, a UUV having these capabilities and which is coupled with a towed antenna system designed to carry out communication to and from the UUV may be more maneuverable and controllable underwater (e.g., 3 to 5 meters below the surface) than it would be if, for example, the UUV were floating on the surface and subjected to waves and wind. A submerged UUV coupled to a towed antenna system may also minimize visibility of the overall UUV-towed antenna system during clandestine operations while allowing the UUV to continue its mission without having to resurface to obtain, for example, updated GPS position information.

SUMMARY OF THE INVENTION

A communication system is disclosed comprising an underwater vehicle configured for communicating with at least one remote communication system while the underwater vehicle is submerged, the underwater vehicle being connected to and configured for communicating with a towable body that is configured to communicate data signals to and from the underwater vehicle and to and from the at least one remote communication system while the underwater vehicle is submerged under water and while the towable body is deployed at or near the surface of the water.

In one embodiment, the underwater vehicle is an unmanned underwater vehicle. The underwater vehicle may be in communication with the at least one remote communication system and the towable body while the underwater vehicle is submerged under water and towing the towable body at or near the surface of the water.

The towable body may receive data signals from a global positioning system (GPS) reflecting a real time geographical position of the underwater vehicle. The towable body may transmit and receive data signals to and from at least one of the remote communication systems via at least one of an RF connection, a Wi-Fi connection, and a satellite connection.

In an embodiment, the at least one remote communication system comprises at least one of a GPS communication system, a satellite communication system, a Wi-Fi communication system, and an RF communication system.

In another embodiment, the underwater vehicle comprises a removably insertable towable antenna system, comprising a hull segment for connecting with at least one adjacent hull segment of the underwater vehicle, a launch and recovery system removably secured to the hull segment, where the launch and recovery system deploys and retrieves the towable body from and to the underwater vehicle, and a cable connecting the towable body to the launch and recovery system and connecting the launch and recovery system to the underwater vehicle. The cable transmits electrical power from a power source in the underwater vehicle to the towable body and transports data signals between the underwater vehicle and the towable body.

In one embodiment, the cable comprises a coaxial cable. The coaxial cable may include an inner conducting member and an outer conducting member, where the inner conducting member transmits electrical power from the underwater vehicle to the towable body and the outer conducting member transports data signals between the underwater vehicle and the towable body.

In another embodiment, the cable comprises a fiber optic cable. The fiber optic cable may include at least two optical fibers, where one optical fiber transmits electrical power from the underwater vehicle to the towable body and another optical fiber transports data signals between the underwater vehicle and the towable body.

A towable antenna system for an unmanned underwater vehicle is disclosed, comprising a launch and recovery system removably secured to the unmanned underwater vehicle, and a towable body tetheringly connected to the launch and recovery system by a cable that transports data signals between the towable body and the unmanned underwater vehicle. The towable body is configured for communicating with at least one remote communication system. Using the cable, the launch and recovery system retrievably deploys the towable body from a first position to a second position while the unmanned underwater vehicle is submerged under water to enable the unmanned underwater vehicle to communicate with the at least one remote communication system.

A profile of the towable body may approximately conform to an outer portion of the unmanned underwater vehicle when the towable body is in the first position. The towable body may be located at or near or on the surface of the water when the towable body is in the second position.

The towable body may include at least one communication system that receives and transmits data signals to and from the unmanned underwater vehicle and to and from the at least one remote communication system. In one embodiment, the at least one remote communication system includes at least one of a GPS communication system, a satellite communication system, a Wi-Fi communication system, and an RF communication system.

The towable antenna system may further include a hull segment removably connected with at least one adjoining hull segment of the unmanned underwater vehicle for housing the launch and recovery system and the towable body aboard the unmanned underwater vehicle. The cable may transmit electrical power to the towable body from the unmanned underwater vehicle.

A towable body for an underwater vehicle is disclosed, comprising a top section including at least one antenna for communicating with at least one remote communication system, and a bottom section connected to the top section. The bottom section comprises a cavity having at least one communication system removably housed therein for communicating with the at least one remote communication system through the at least one antenna and for communicating with the underwater vehicle.

The top section may include a profile that approximately conforms with at least a portion of an outer profile of the underwater vehicle when the towable body is in a stowed position relative to the underwater vehicle. The towable body may further include an antenna housing extending from a top surface of the top section and housing the at least one antenna to assist the at least one antenna in acquiring and maintaining at least one communication link with the at least one remote communication system while the towable body is at or near the surface of the water and while the underwater vehicle is submerged under the surface of the water.

The towable body may be deployable from a stowed position relative to the underwater vehicle while the underwater vehicle is submerged under water to a deployed position at or near the surface of the water to form at least one communication link between the at least one remote communication system and the underwater vehicle.

The towable body may further include a keel. The towable body may further include a rudder. In one embodiment, the rudder comprises a fixed position. In another embodiment, at least a portion of the rudder is movable side to side via at least one servo motor.

In an embodiment, the towable body is buoyant. The towable body may comprise a hydrodynamic lift-to-drag ratio greater than approximately 1.0 to enable the towable body to rise to the surface of the water when deployed from the underwater vehicle. In one embodiment, the towable body includes a circumferentially swept airfoil cross section.

In an embodiment, the at least one remote communication system comprises at least one of a GPS communication system, a satellite communication system, a Wi-Fi communication system, and an RF communication system. In another embodiment, the top section includes an aperture covered by a removably replaceable cap for providing access to the cavity of the towable body.

The bottom section and the top section may be separable and recombinable with one another. Alternatively, the bottom section is integratingly formed with the top section.

A launch and recovery system for a towable antenna system for use with an unmanned underwater vehicle is disclosed, comprising a drive system for retrievably deploying a towable antenna system to and from a unmanned underwater vehicle, and a launch and recovery communication system connected to the drive system for communicating data signals to and from the towable antenna system and the unmanned underwater vehicle and for transmitting power from the unmanned underwater vehicle to the towable antenna system, where the launch and recovery system is operable when submersed in water.

The drive system may include an electric motor operable on commands received from the unmanned underwater vehicle or the towable antenna system to deploy and retrieve the towable antenna system from and to the unmanned underwater vehicle and to and from the surface of the water. The drive system may also include a first end block releasably connected to a baseplate, the first end block forming a mount for the electric motor. The drive system may further include a first end cap connected to the first end block for forming a water-tight seal therebetween. The drive system may additionally include a first connector for connecting the drive system to a power source of the unmanned underwater vehicle, the connector forming a water-tight seal with the first end cap.

The launch and recovery communication system may include a slip ring assembly for communicating data signals to and from the towable antenna system and the unmanned underwater vehicle and for transmitting power from the unmanned underwater vehicle to the towable antenna system. The launch and recovery communication system may also include a second end block releasably connected to a baseplate, the second end block forming a mount for the slip ring assembly. The launch and recovery communication system may further include a second end cap connected to the second end block for forming a water-tight seal therebetween. The launch and recovery communication system may additionally include a second connector for connecting the launch and recovery communication system to a communication system of the unmanned underwater vehicle, the second connector forming a water-tight seal with the second end cap.

The launch and recovery system may further comprise a drum driven by the drive system, the drum configured to reel and unreel a cable thereon, the cable being connectable to the launch and recovery communication system on one end and to the towable antenna system on the other end, the cable being configured for transmitting electrical power from a power source in the unmanned underwater vehicle to the towable antenna system and for transporting data signals between the unmanned underwater vehicle and the towable antenna system.

BRIEF DESCRIPTION OF THE DRAWINGS

For a better understanding of the invention, reference may be had to preferred embodiments shown in the following drawings in which.

DETAILED DESCRIPTION

Although the figures and the following disclosure describes an embodiment involving an unmanned underwater vehicle (UUV), one of ordinary skill in the art would know that the teachings of the disclosure would not be limited to use solely in connection with UUVs, and instead would appreciate that the teachings of the following disclosure would also apply to any submersible craft.

Figure 1:
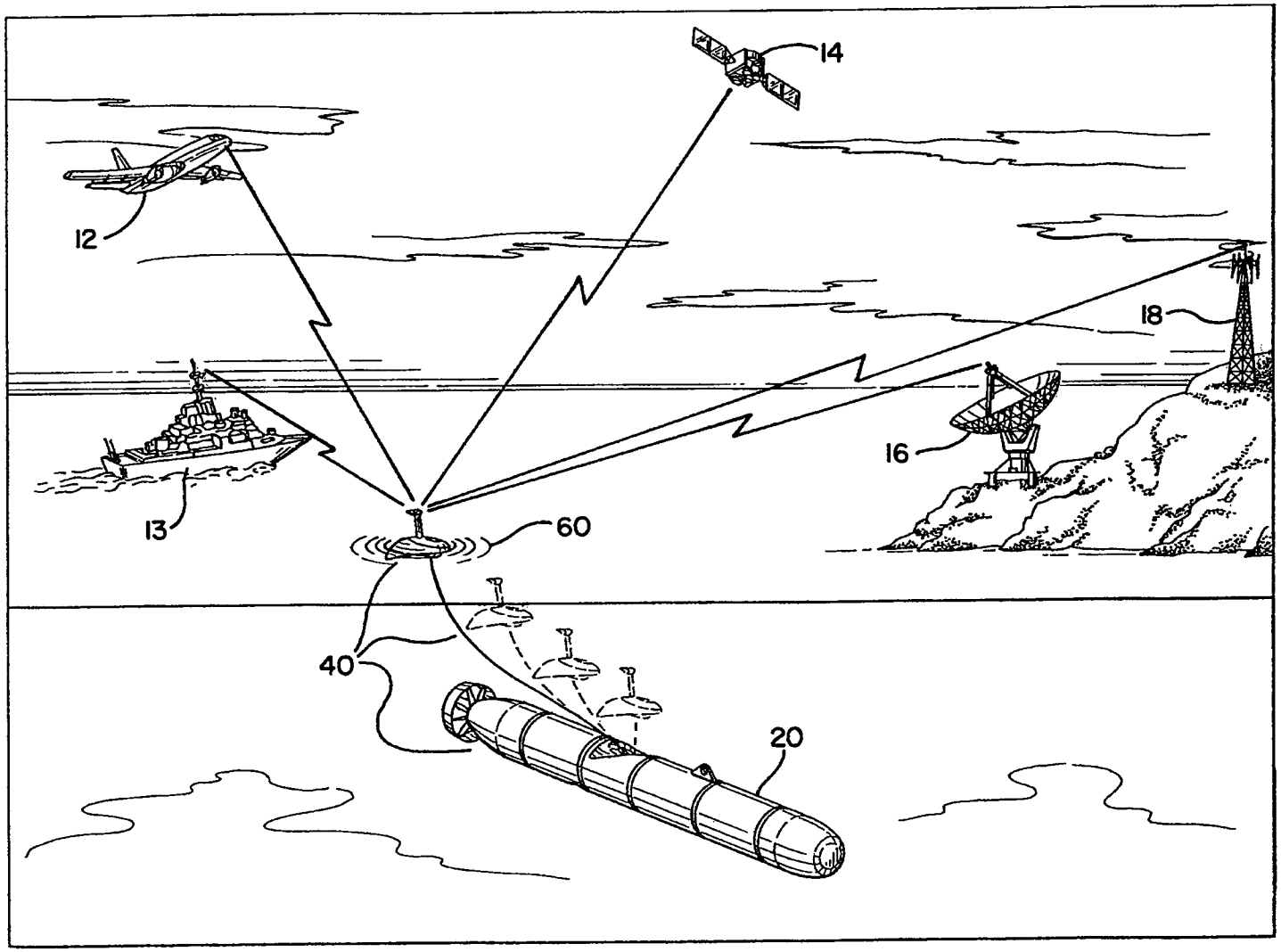
FIG. 1 illustrates a system incorporating one embodiment of a towed antenna system.

Turning now to the figures, wherein like reference numerals refer to like elements, there is illustrated in FIG. 1 system 10 incorporating an embodiment of the present invention. FIG. 1 shows how an underwater vehicle, such as UUV 20, which is submerged under the surface of the water, may deploy towed body 60 to the surface of the water to transmit and receive communication signals to and from various remotely located communication systems. System 10 of FIG. 1 includes UUV 20 and towed antenna system 40. System 10 may also include watercraft 13, which may comprise at least one ship, boat, hovercraft, pontoon, buoy, beacon, or relay, to name a few. System 10 may also include aircraft 12, which may comprise at least one manned or unmanned aircraft or rotorcraft, cruise missile, or lighter-than-air craft, such as a balloon, for example. System 10 may further include satellite 14, which may comprise at least one GPS satellite and at least one communications satellite, such as the Iridium constellation of satellites. System 10 may additionally include one or more terrestrial communication systems 16,18. Terrestrial communication systems 16,18 may include, for example, one or more RF communication systems operating on one or a number of frequencies, including Wi-Fi, microwave, UHF, VHF, spread-spectrum, cellular, and PCS communication systems.

UUV 20, through towed antenna system 40, may initiate and bi-directionally communicate with one or more of aircraft 12, watercraft 13, satellite 14, and terrestrial communication systems 16,18. Similarly, one or more of aircraft 12, watercraft 13, satellite 14, and terrestrial communication systems 16,18 may initiate and bi-directionally communicate with UUV 20 through towed antenna system 40. Bi-directional communication may simultaneously occur between UUV 20 and one or more of any or all of aircraft 12, watercraft 13, satellite 14, and terrestrial communication systems 16,18.

Figure 2:
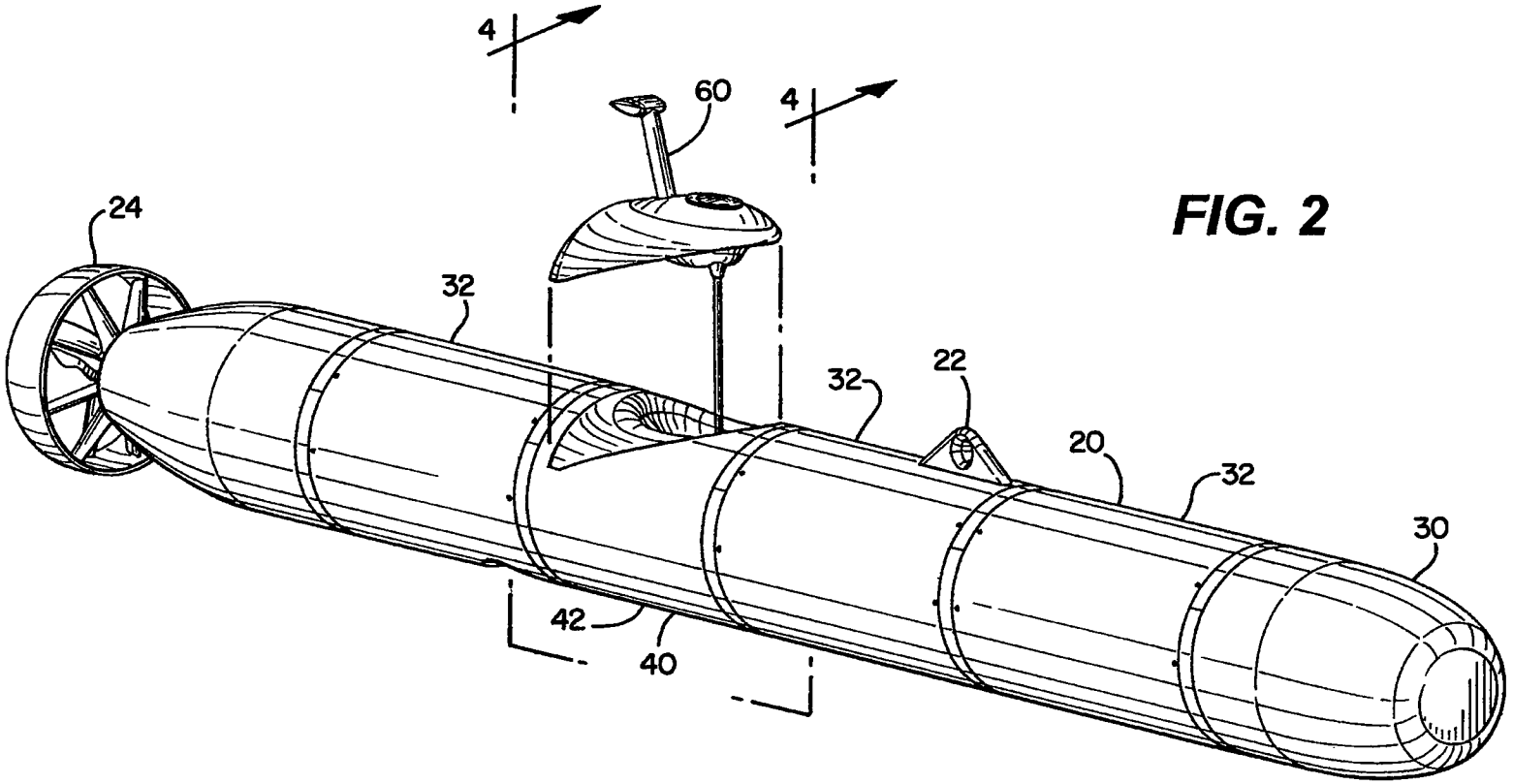
FIG. 2 illustrates a perspective view of an unmanned underwater vehicle incorporating the towed antenna system shown in FIG. 1.

Turning now to FIG. 2, there is shown a more detailed view of UUV 20 together with towed antenna system 40, and further showing towed body 60 partially deployed. UUV 20 may include, for example, nose module 30, propulsion and guidance module 24, lift hoist 22, and one or more interchangeable modules 32 that, when assembled together, form UUV 20. One of modules 32 may include one or more electrical power sources, such as power supply 157 shown schematically on, for example, FIG. 27. In addition, UUV 20 may include one or more computers, such as computer 155 shown schematically on, for example, FIG. 27. Computer 155 executes preprogrammed computer instructions to autonomously direct UUV 20 to carry out a predetermined underwater mission as well as to direct the deployment and retrieval of towed body 60 and operation of towed antenna system 40. Computer 155 is additionally configured to engage towed antenna system 40 to permit communication of UUV 20 with remote air, water, space, and terrestrial communication systems.

Figure 3:
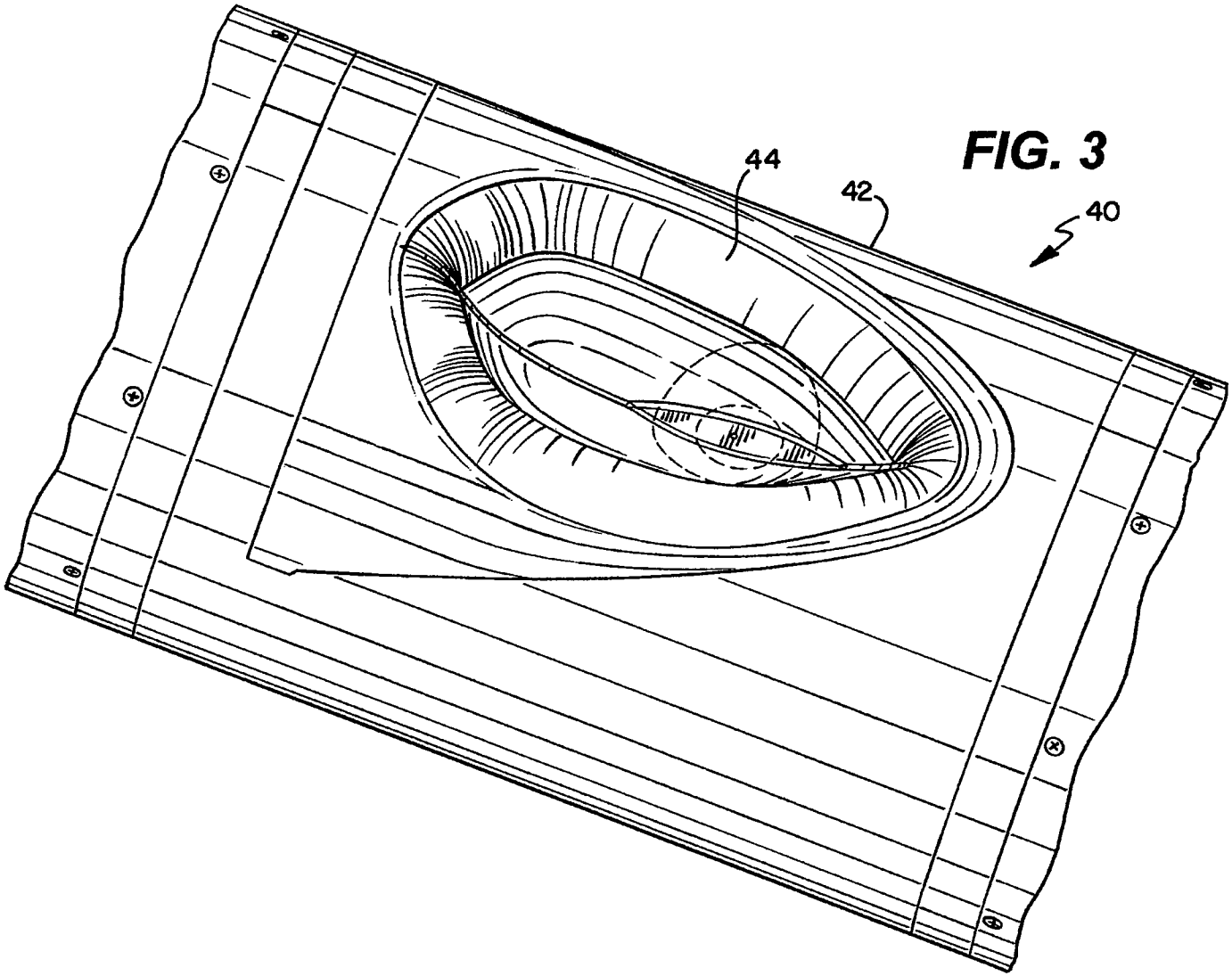
FIG. 3 illustrates a partial detail perspective view of the towed antenna system shown in FIG. 2.

Turning to FIG. 3, towed antenna system 40 includes hull segment 42, which may include receptacle 44 for receiving towed body 60. In addition, as is shown in the figures, towed body 60 may be configured to conform with hull segment 42 and vice versa to minimize drag on UUV 20 during underwater operations of UUV 20 when towed body 60 is fully retracted and engaged with UUV 20.

Figure 4:
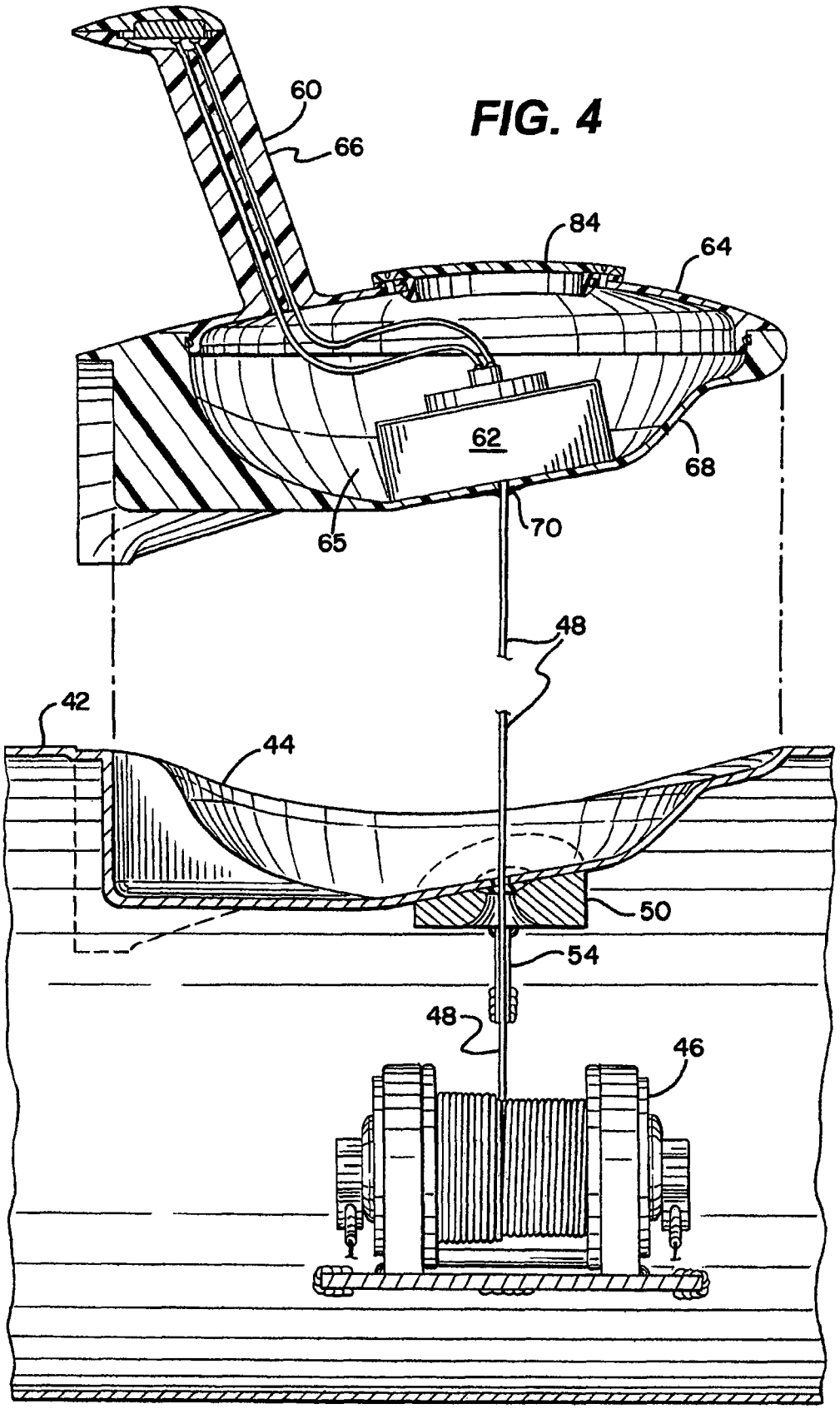
FIG. 4 illustrates a partial detail cross sectional view of the towed antenna system shown in FIG. 2 with a towed body in a partially deployed configuration.

Turning to FIG. 4, there is shown a more detailed view of towed antenna system 40 shown with towed body 60 in a partially deployed configuration. Towed antenna system 40 includes, for example, hull segment 42 for interchangeably mounting to adjoining modules 32. Hull segment 42 may additionally be configured as a platform upon which to attach and secure launch and recovery system 46 for deployment and retrieval of towed body 60 from UUV 20 to and from the surface of the water. The forward and aft ends of hull segment 42 may be configured, for example, to maintain a watertight connection with adjoining modules 32.

Towed antenna system 40 also includes towed body 60 connected to cable system 48, which is connected to launch and recovery system 46, and which is ultimately connected at least electrically to the electronics and one or more power supplies housed in one or more modules 32 of UUV 20. Accordingly, cable system 48 is configured not only to act as a tether for deployment and retrieval of towed body 60 to and from UUV 20, but cable system 48 also serves the function of, for example, transporting electrical power to towed body 60 from UUV 20 and for transmitting data signals between towed body 60 and UUV 20. Such data signals may include, for example, real-time digital or analog video and voice signals as well as digital or analog data signals. In one embodiment, towed body 60 includes a camera for taking digital photographs and digital video, which may, for example, be streamed real-time to at least one of the remote communication systems. The taking of digital photographs and digital video may be autonomously performed according to a preprogrammed mission, or may be the result of a user remotely operating the camera in real-time via a communications link with towed antenna system 40.

Towed body 60 is further configured to house various antennas and associated electronics usable for receiving and transmitting data signals to and from UUV 20 and to and from aircraft 12, watercraft 13, satellite 14, and terrestrial communication systems 16,18 while UUV 20 is permitted to be submersed below the surface of the water.

As is shown in FIG. 4, launch and recovery system 46 may comprise, for example, a powered underwater winch, usable for deploying and retrieving towed body 60. Power for launch and recovery system 46 may be provided by one or more power sources contained in other modules 32 of UUV 20. To deploy towed body 60, launch and recovery system 46 may unwind, and therefore let out, a predetermined length of cable system 48 knowing, for example, the depth of UUV 20 below the surface of the water. Alternatively, launch and recovery system 46 may unwind, and therefore let out, a length of cable system 48 until, for example, a sensor senses slack in cable system 48. Deployment and retrieval of towed body 60 may be performed at preprogrammed times or intervals, as may be programmed in and commanded by the computer connected to or part of UUV 20.

Once towed body 60 is deployed at or near or on the surface of the water, towed antenna system 40 may autonomously attempt to open one or more communication channels to permit bi-directional communication with remote air, water, space, and terrestrial communication systems via, for example, RF and satellite methodologies. Once one or more communication channels are established between one or more remote air, water, space, and terrestrial communication systems, towed antenna system 40 may carry out bi-directional communication of data signals between such one or more remote air, water, space, and terrestrial communication systems and computer 155 onboard UUV 20. In this way, UUV 20 may remain completely submersed and hidden from view. In one embodiment, UUV 20 is submersed approximately 3-5 meters below the surface of the water when towed body 60 is deployed at the surface of the water.

Alternatively or additionally, towed antenna system 40 may autonomously attempt to receive GPS position data to update computer 155 onboard UUV 20 with updated actual geographical position information of UUV 20. Priority between one or more bi-directional communication channels or GPS data acquisition may be predetermined, such as, by knowing the predicted route that UUV 20 is programmed to make under water and knowing in advance what communication systems will likely be available at predetermined times of deploying towed body 60. Alternatively, computer 155 or a computer of towed antenna system 40 may cycle through available communication options or attempt to open all available communication options simultaneously. If multiple communication options are available at a given point in time, computer 155 or towed antenna system 40 may open all available communication channels or any number less than all available communication channels. Once at least one communication link is made with at least one remote communication system, remote control and operation of UUV 20 and towable system 40 may be made by a remote user.

Figure 5:
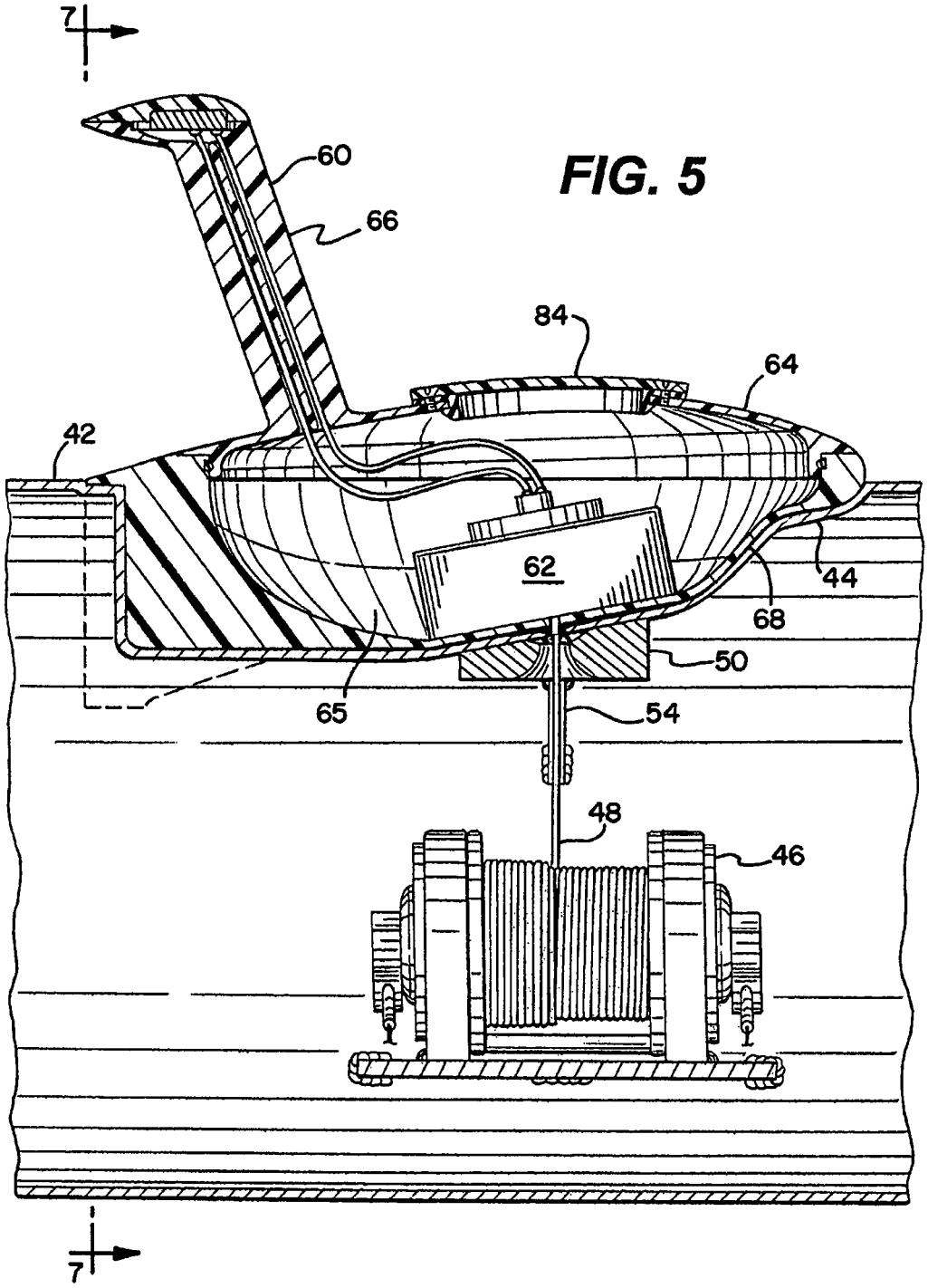
FIG. 5 illustrates a partial detail cross sectional view of the towed antenna system shown in FIG. 2 with a towed body in a fully retracted configuration.

To retrieve towed body 60 from a deployed position, launch and recovery system 46 may reverse the process and wind cable system 48 until towed body 60 is once again seated against hull segment 42 of towed antenna system 40. A locking mechanism may be provided to secure towed body 60 in its fully retracted position. To avoid overstretching cable system 48 during retrieval operations, launch and recovery system 46 may cease winding of cable system 48 when launch and recovery system senses, for example, a threshold resistance in cable system 48 or in launch and recovery system 46. In one embodiment, towed antenna system 40 includes proximity switch 214 to sense retraction of towed body 60 against hull segment 42. When proximity switch 214 is triggered, launch and recovery system 46 may cease winding of cable system 48. FIG. 5 illustrates towed antenna system 40 with towed body 60 in its fully retracted position.

Figure 6:
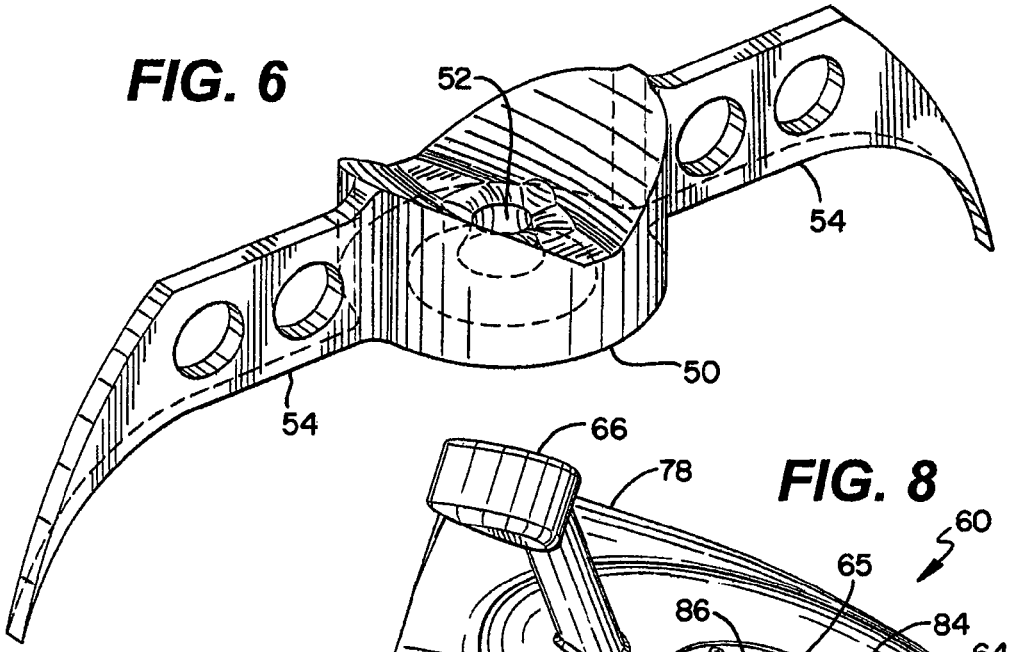
FIG. 6 illustrates a perspective view of an exemplary cable guide shown in FIGS. 4 and 5.

To assist in the deployment and retraction of towed body 60, towed antenna system 40 may include cable guide 50 to guide cable system 48 neatly onto a drum or spool of launch and recovery system 46 and to guide cable system 48 during deployment of towed body 60. As shown in FIG. 6, cable guide 50 may include aperture 52 through which cable system 48 may be guided during deployment and retraction of towed body 60. In addition, cable guide 50 may include one or more support members 54, which may be fixedly mounted to an inner wall of hull segment 42 so as to suspend cable guide 50, and aperture 52, in a predetermined point and space within hull segment 42. In the embodiment shown in FIGS. 4-5 and 7, cable guide 50 may be positioned directly underneath towed body 60 when towed body 60 is in its fully retracted position and engaged with hull segment 42. Cable guide 50 may be made from any material that is lightweight, durable, and suitable for underwater use including salt water environments. In one embodiment, cable guide 50 is made from a plastic. In another embodiment cable guide 50 is made from a composite material.

Figure 7:
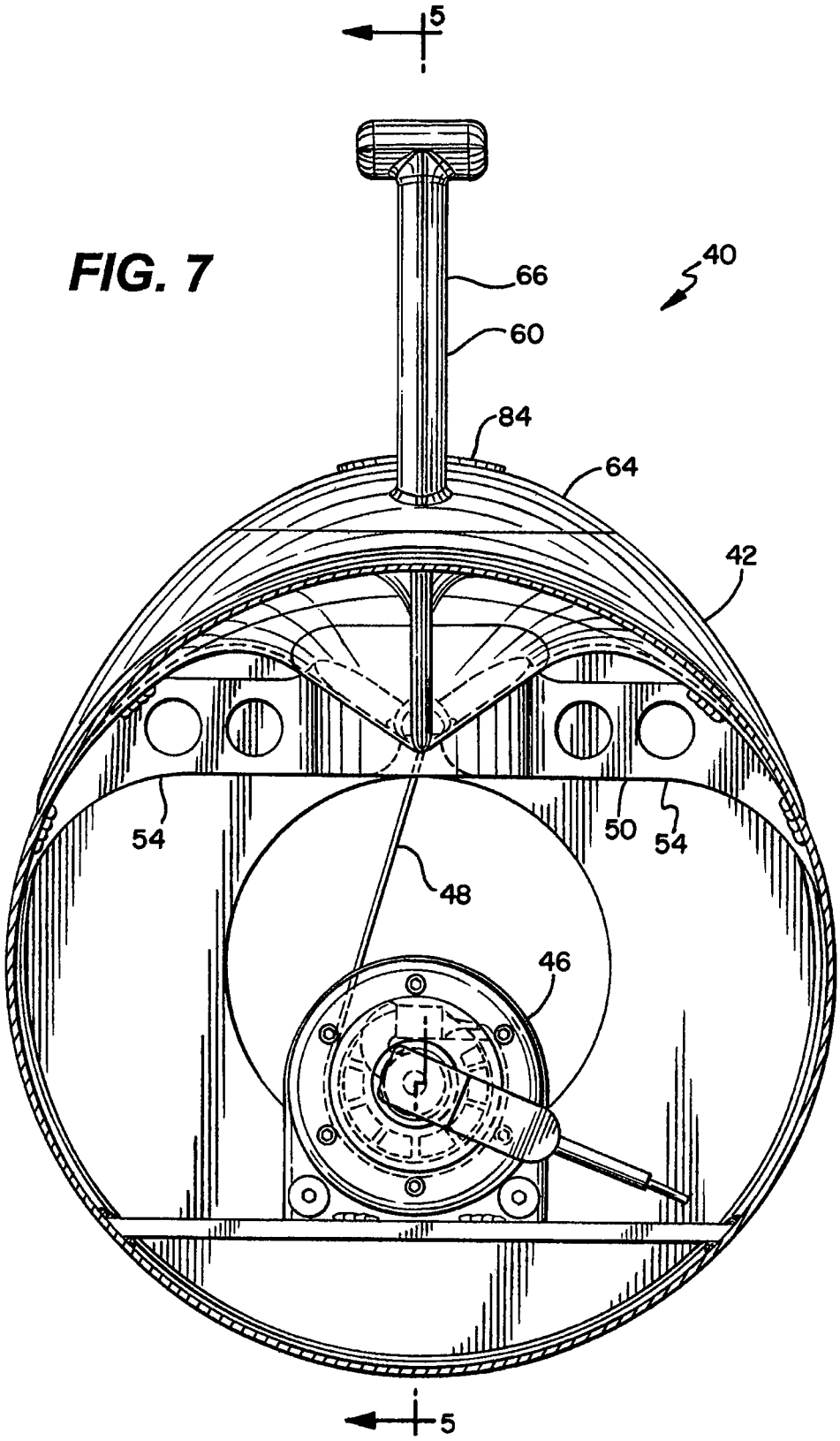
FIG. 7 illustrates a cross sectional view of the towed antenna system shown in FIG. 5.
Figure 10:
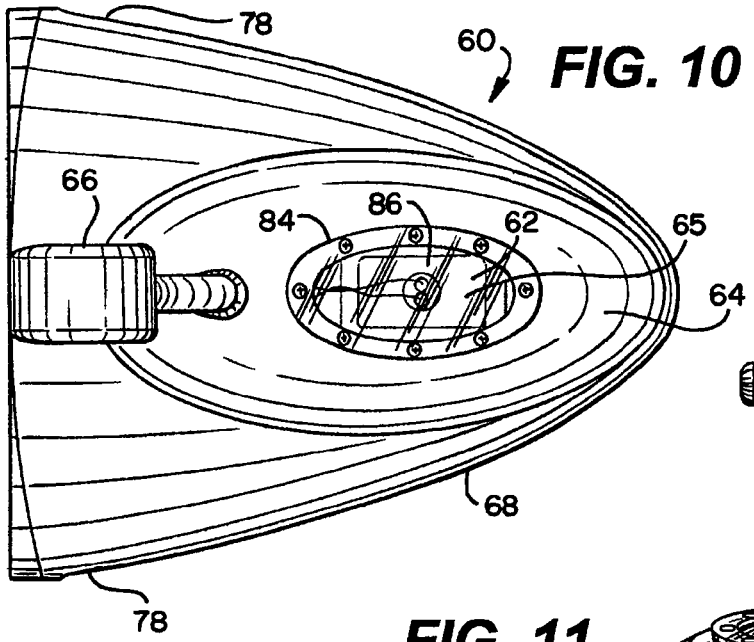
FIG. 10 illustrates a top plan view of the towed body shown in FIG
Figure 11:
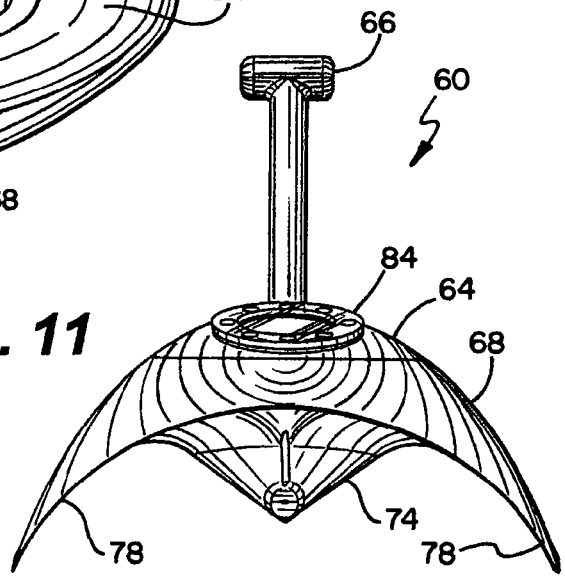
FIG. 11 illustrates a front elevational view of the towed body shown in FIG. 8.
Figure 12:
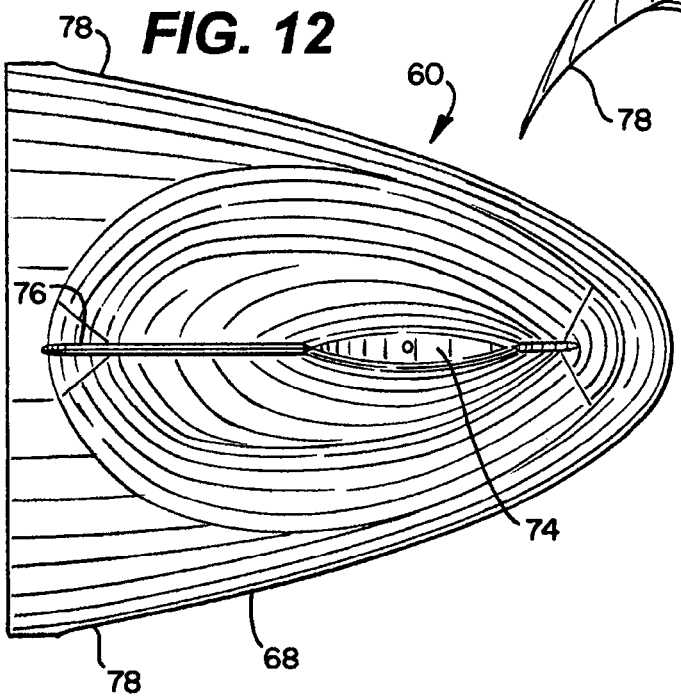
FIG. 12 illustrates a bottom plan view of the towed body shown in FIG. 8.

Turning to FIG. 7, towed antenna system 40 is shown with towed body 60 in a fully retracted position. Launch and recovery system 46 is shown positioned underneath towed body 60, and secured to hull segment 42. Although launch and recovery system 46 is shown in the figures as being permanently secured to hull segment 42, launch and recovery system 46 may alternatively be configured to be removeably secured to hull segment 42.

Figure 8:
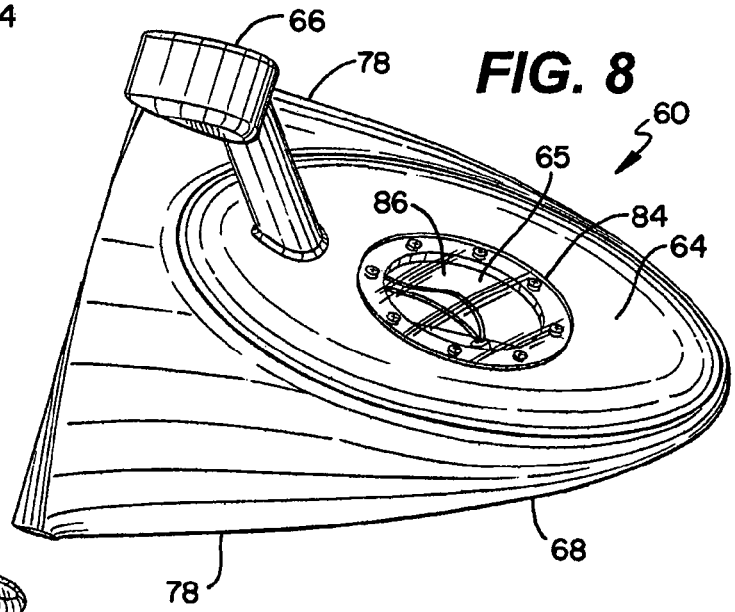
FIG. 8 illustrates a top perspective view of one embodiment of a towed body.

Turning now to FIGS. 8-14, there is shown in detail an exemplary towed body 60. In FIG. 8 which shows a top perspective view of an exemplary towed body 60, for example, towed body 60 includes antenna housing 66, top section 64, bottom section 68, cavity 65, and access cap 84.

Figure 9:
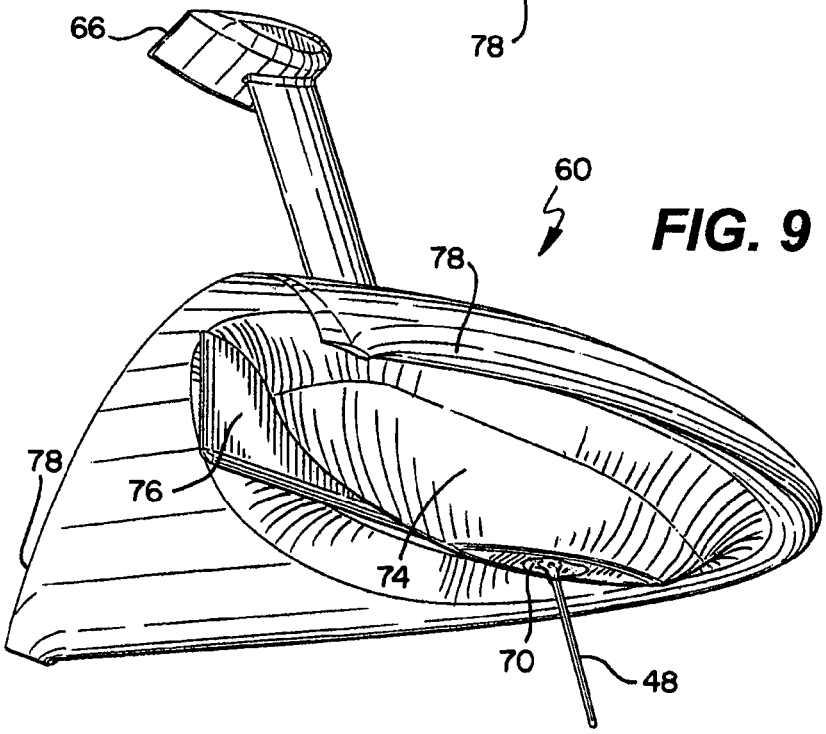
FIG. 9 illustrates a bottom perspective view of the towed body shown in FIG. 8.

FIG. 9 shows a bottom perspective view of an exemplary towed body 60 shown in FIG. 8, and shows towed body 60 may additionally include keel 74, right and left pontoons 78, rudder 76, and cable system 48 positioned through an aperture formed in keel 74. In addition, at the entrance point of cable system 48 through the aperture in keel 74, there is shown seal 70, which is configured for ensuring that the cable-keel interface forms a water-tight seal. In one embodiment, seal 70 includes a flexible epoxy and a flexible polysulfide strain relief.

Figure 13:
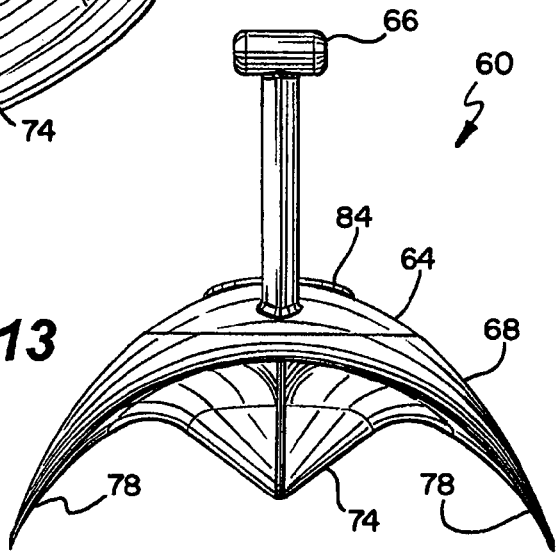
FIG. 13 illustrates a rear elevational view of the towed body shown in FIG. 8.
Figure 14:
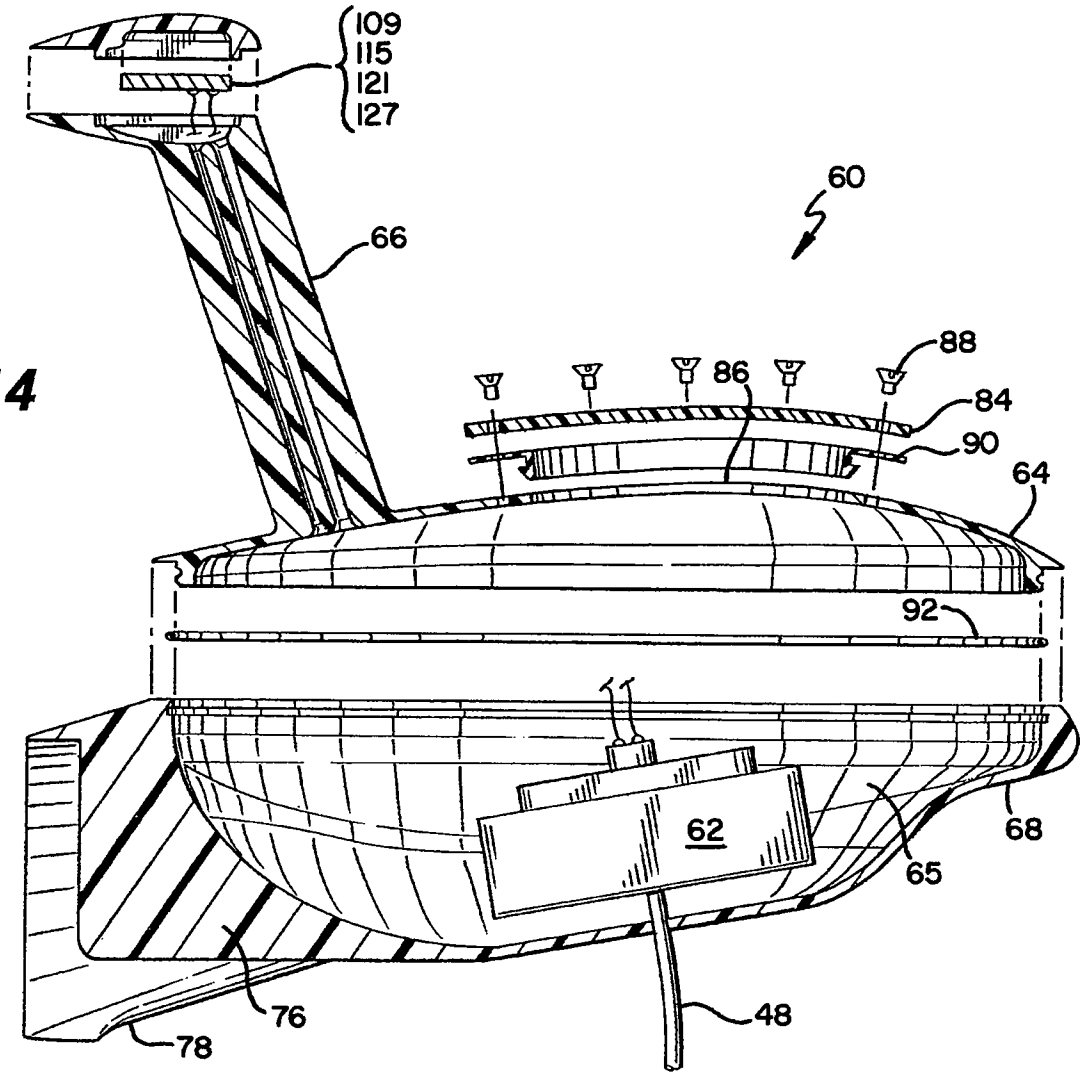
FIG. 14 illustrates is an exploded cross sectional view of the towed body shown in FIG. 13.

Turning to FIG. 14, there is shown a cross-section of the exemplary towed body 60 shown in FIG. 13. For example, towed body 60 is shown as including a plurality of fasteners 88 for securing access cap 84 to top section 64. In addition, there is shown seal 90 between cap 84 and top section 64 for forming a water-tight seal when fasteners 88 are secured to top section 64. In another embodiment, towed body 60 is formed without aperture 86. Top section 64 may be fastened or secured to bottom section 68 using any known means, such as, for example, by snapping the two sections together or by securing the two sections together with adhesive or with fasteners. Alternatively, top section 64 may be integrally formed with bottom section 68 to form towed body 60.

Antenna housing 66 may include one or more antennas, including GPS antenna 109 and satellite antenna 115, for example. Antenna housing 66 may also include an appropriate GPS receiver and/or an appropriate satellite receiver permanently potted within antenna housing 66. Antenna housing 66 may also include Wi-Fi antenna 127 and/or RF antenna 121. Antenna housing 66 may further include a Wi-Fi cable for connecting Wi-Fi antenna 127 to a Wi-Fi transceiver, which may be housed in electrical housing 62 secured in cavity 65 of bottom section 68 of towed body 60. Alternatively or additionally, antenna housing 66 may include a GPS/satellite cable connected to a GPS receiver and/or a satellite transceiver, both of which may be housed in electrical housing 62 in cavity 65 of bottom section 68 of towed body 60.

Top section 64, as shown in FIG. 14, may be interchangeable with other top sections 64 having different configurations of GPS/satellite/Wi-Fi/RF antennae and receiver/transceiver hardware.

Seal 92, which may be made from, for example, an elastomeric material, may be positioned between top section 64 and bottom section 68 to form a water-tight seal therebetween. In this way, top section 64 may be removably replaced with another top section 64 having a different antenna and communication hardware configuration stored therein.

Bottom section 68 also includes cavity 65 for positioning electrical housing 62. Electrical housing 62 is optional if the communications package is merely installed in cavity 65.

Antenna housing 66, as shown in FIG. 14, is shown as extended above the top surface of top section 64 to best position GPS antenna 109, satellite antenna 115, or Wi-Fi antenna 127 as high above the surface of the water as possible without being easily visually detected. Antenna housing 66 may be in a fixed position and in a fixed length, or it may be deployable and retractable, in, for example, a telescoping manner. One of ordinary skill would appreciate that antenna housing 66, and towed body 60, may be configured in any number of ways. In one embodiment, antenna housing 66 is configured in the shape of a relatively small blister. In another embodiment, antenna housing 66 is non-existent, where the RF, Wi-Fi, GPS, satellite and cellular antennas are housed inside tow body 60.

As shown in the figures, towed body 60 may comprise an airfoil shape to provide hydrodynamic lift during deployment under water. In one embodiment, the airfoil shape is based on a NACA5515 airfoil cross section. The airfoil cross sectional shape may be swept to match the shape of any diameter of UUV 20 to approximately conform towed body 60 to the contour of the outer surface of UUV 20. In this way, towed body 60 will allow UUV 20 to function as close to normal as possible during periods when towed body 60 is stowed, which could be up to approximately 94%, for example, of an entire UUV 20 mission.

In one embodiment, towed body 60 is buoyant to cause towed body 60 to float to the surface of the water on deployment from UUV 20 and to operate at or on the surface of the water to communicate with the at least one remote communication system. Towed body 60 may additionally be configured with a lift-to-drag ratio of greater than approximately 1.0 to permit towed body 60 to hydrodynamically "fly" to the surface of the water on deployment from UUV 20. In one embodiment, towed body 60 is configured with powered control surfaces that are movable via one or more servo motors, for example, to control towed body 60 while deployed under water and at or on the surface of the water. In another embodiment, towed body 60 is configured with powered control systems to propel and control towed body 60 while deployed under water and at or on the surface of the water. Towed body 60 may be made from any material that is lightweight, durable, and suitable for underwater use including salt water environments. In one embodiment, towed body 60 is made from a plastic. In another embodiment, towed body is made from a composite material. Rudder 76 of towed body 60 may be fixed or it may be moveable, for example, using one or more servo motors to permit additional directional control of towed body 60 during deployment under water and at or on the surface of the water. Access cap 84 may be removed from top section 64 to gain access to, for example, the electronics housed in cavity 65 of towed body 60. In this way, quick access to such contents may be obtained without having to disturb the water-tight seal between top section 64 and bottom section 68.

It should be understood by one of ordinary skill that a substantial portion of towed body 60 may be submerged, at least momentarily, while towed body 60 is at or on the surface of the water without causing loss of connectivity with the at least one remote communication system and without departing from the teachings of the instant disclosure. For example, top section 64 may be partially or completely submerged but, for example, the top of antenna housing 66 may remain above water thereby maintaining communications between the one or more antennae housed therein with the at least one remote communication system. In addition, towed body 60 may be completely submerged near the surface of the water and be in communication with the at least one remote communication system.

Turning now to FIGS. 15-19, there is shown various exemplary options for cable system 48. Cable system 48 may comprise, for example, mini coaxial cable 282. Cable 282 may comprise, for example, an approximately 0.046 inch diameter or an approximately 0.100 inch diameter, either of which is relatively small compared to many other cable system options. The relatively small diameter of cable 282 serves to minimize drag while towing deployed towed body 60, yet still be large enough to transmit both power and data signals between towed body 60 and UUV 20. In this way, a two-wire protocol may be employed to transmit data on, for example, conductor 288 and power on, for example, shield 286, or vice versa.

Figure 15:
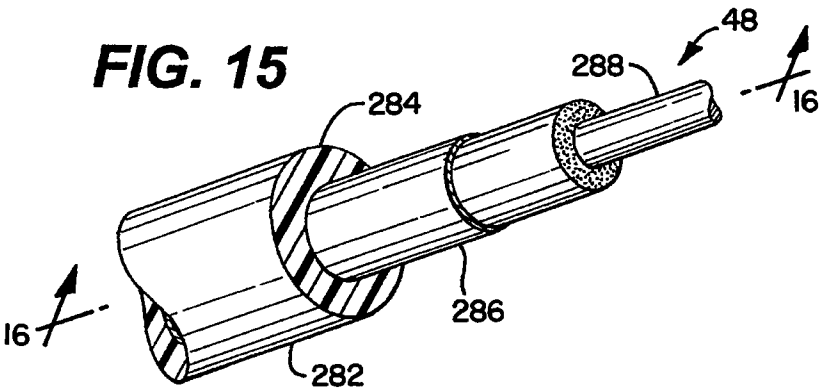
FIG. 15 illustrates an exemplary cable system usable in connection with the system shown in FIG. 1.
Figure 16:
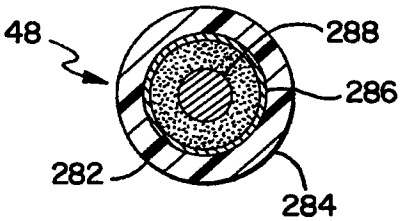
FIG. 16 illustrates is a cross sectional view of the cable system shown in FIG. 15.

In the embodiment of FIGS. 15-16, cable 282 comprises cover 284, shield 286, and conductor 288. Cover 284 may comprise an FEP jacket. Conductor 288 may comprise an approximately 34 AWG silver plated steel conductor. Shield 286 may comprise tinned copper. Tensile strength of cable 282 is anticipated to be approximately 10 lbs, which is well in excess of an approximately 3 lb. tensile load that is expected to be applied to cable system 48 during deployment of one embodiment of towed body 60. Cable 282 may be capable of supporting up to approximately 600 volts and approximately 0.2 amps. However, since the electrical current is relatively low, the voltage may need to be increased to provide enough power for the electronics housed in towed body 60. In addition, by adding an in-line filter, data and electrical power may be transmitted using a single cable 282 for cable system 48.

Figure 17:
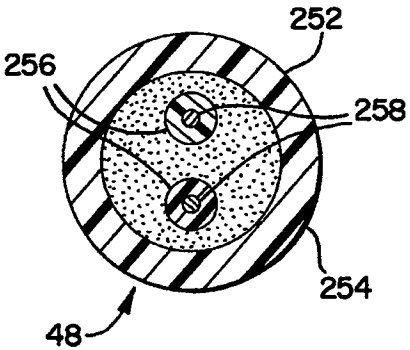
FIG. 17 illustrates a cross sectional view of another embodiment of a cable system usable in connection with the system shown in FIG. 1.

In another embodiment, cable system 48 comprises cable 252, as shown in FIG. 17. Cable 252 may comprise a fiber optic configuration having cover 254, strength member 256, and dual optical fibers 258. Cover 254 may be made from a waterproof PVC material. Strength member 256 may be made from a strong yet lightweight material, such as Kevlar. Cable 252 may be desirable for long cable runs and/or extremely high bandwidth where multiple data streams may be multiplexed onto a single fiber 258.

Figure 18:
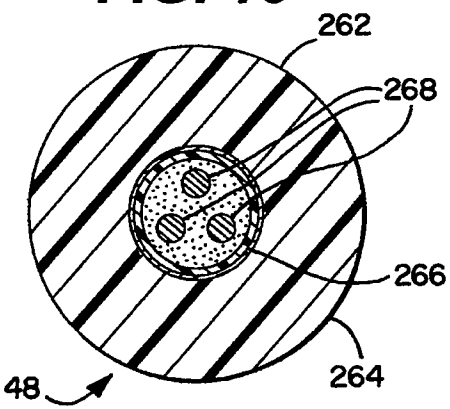
FIG. 18 illustrates a cross sectional view of yet another embodiment of a cable system usable in connection with the system shown in FIG. 1.

FIG. 18 shows another embodiment of cable system 48 comprising cable 262. Cable 262 may include, for example, cover 264, strength member 266, and three optical fibers 268. Cover 264 may comprise, for example, a polyurethane material. Strength member 266 may comprise a relatively strong yet lightweight material such as Kevlar. Fibers 268 may be encased in a gel-filled stainless steel sheath surrounded by strength member 266. Cable 262 may be approximately 0.12 inches in diameter, which may create more drag than, for example, cable 282 during deployment of towed body 60, but may be more rugged in a rough marine environment than, for example, cable 282.

Figure 19:
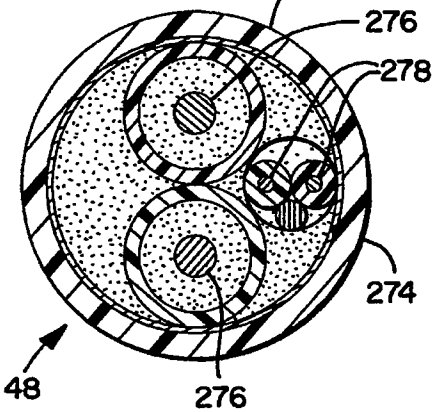
FIG. 19 illustrates a cross sectional view of another embodiment of a cable system usable in connection with the system shown in FIG. 1.

FIG. 19 shows yet another embodiment of cable system 48 comprising cable 272. Cable 272 may include, for example, cover 274, dual conductors 276, and dual fibers 278. In one embodiment, cable 272 is a M2-220 fiber optic cable having an approximately 0.26 in. diameter and which is available from Opticis Co. The relatively large diameter of cable 272, as compared to, for example, cable 282, may cause increased drag during deployment of towed body 60 thereby increasing the tensile loads on cable system 46.

Figure 20:
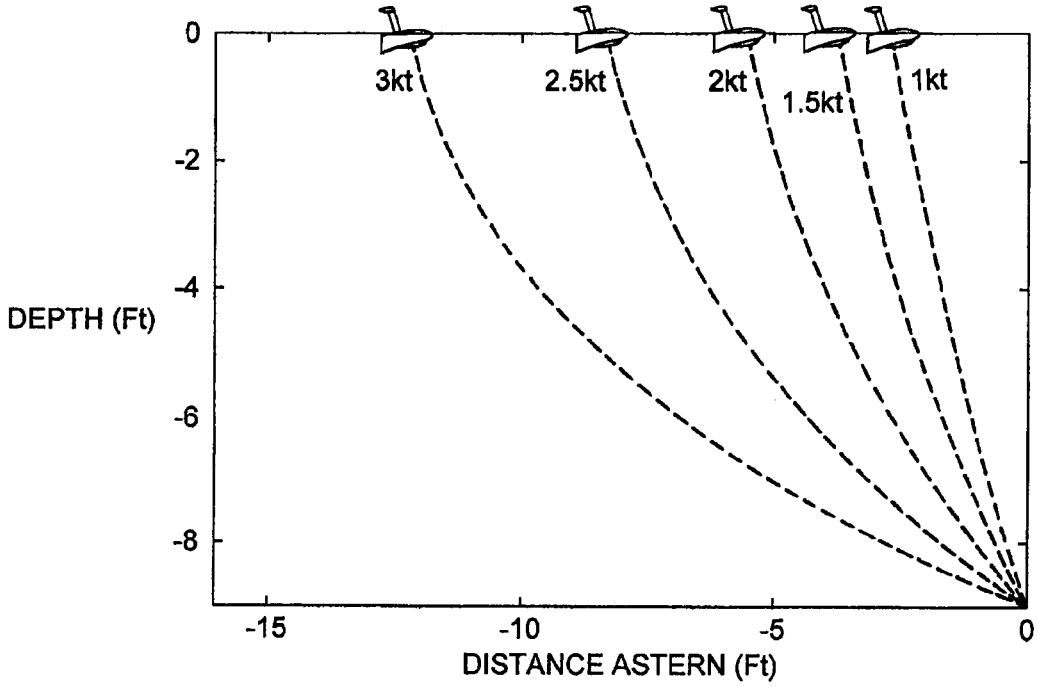
FIG. 20 illustrates test data resulting from a simulation involving the embodiment of the cable system shown in FIG. 18.
Figure 21:
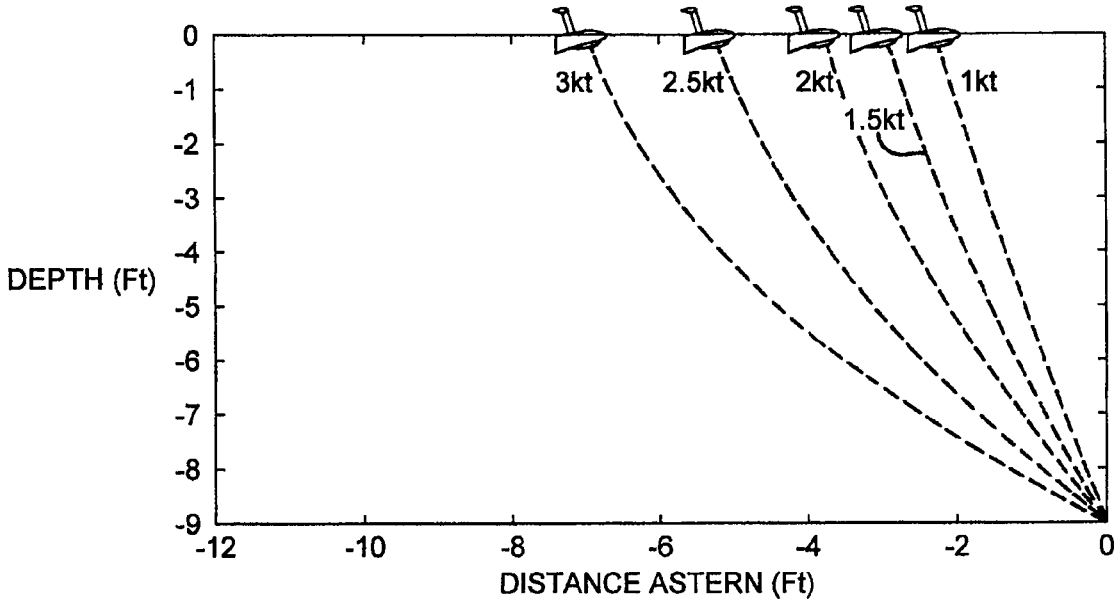
FIG. 21 illustrates test data resulting from a simulation involving the embodiment of the cable system shown in FIG. 15.

While all of the foregoing cable system 48 options would work in connection with towed antenna system 40, testing has shown that cable 282 may provide the potential for deeper deployments and higher underwater speeds of UUV 20 than can be achieved using cable 252 or cable 262, for example. FIG. 20 illustrates the test results of a simulated UUV 20 submersed to approximately 3 meters using cable 252 or cable 262 to tow a simulated towed body 60. FIG. 20, for example, shows the measured distance astern from a simulated UUV 20 traveling at approximately 1 to approximately 3 knots. By comparison, FIG. 21 shows the measured distance astern from a simulated UUV 20 traveling at approximately 1 to approximately 3 knots when towing a simulated towed body 60 using cable 282. As the velocity of the simulated UUV 20 increases, FIG. 21 shows that using cable 282 results in a shorter distance astern as compared to using cable 252 or cable 262 having a diameter of approximately twice that of cable 282—all other factors being approximately equal.

During experimental tests involving a simulated towed body 60, attached to cable 272, which has an approximately 0.26 inch diameter, it was shown that at 2 knots forward speed there was approximately 4 ounces of drag, while at 2.2 knots there were approximately 5 ounces of drag, and at 2.8 knots of forward speed, there was approximately 7 ounces of drag. These drag forces were in the range of what was predicted. Consequently, it is anticipated that cable 282, which is just under approximately 22% of the diameter of cable 272, would result in a fraction of these measured drag forces at these velocities. Consequently, while actual results in a real-life application may vary from the foregoing, the lower drag of cable 282 may provider operators of UUV 20 with a greater depth and speed envelope for UUV 20. In addition, the electrical components may also be simpler and less expensive than their fiber optic counterparts. Durability of cable 282 is also expected to be more rugged than many other options, including many fiber optics options, which may result in less down time, less repair operations, and better monitoring of operational status of UUV 20.

Figure 23:
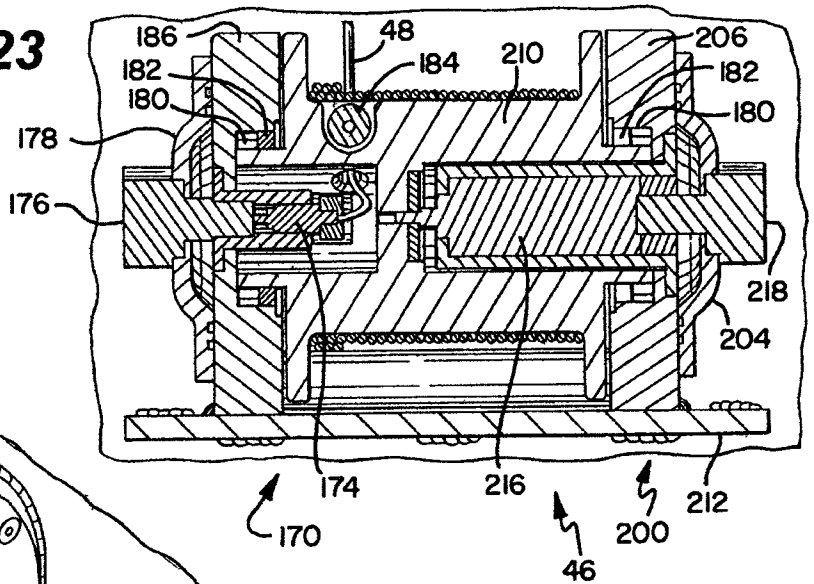
FIG. 23 illustrates a cross sectional view of the launch and recovery system shown in FIG. 22.
Figure 22:
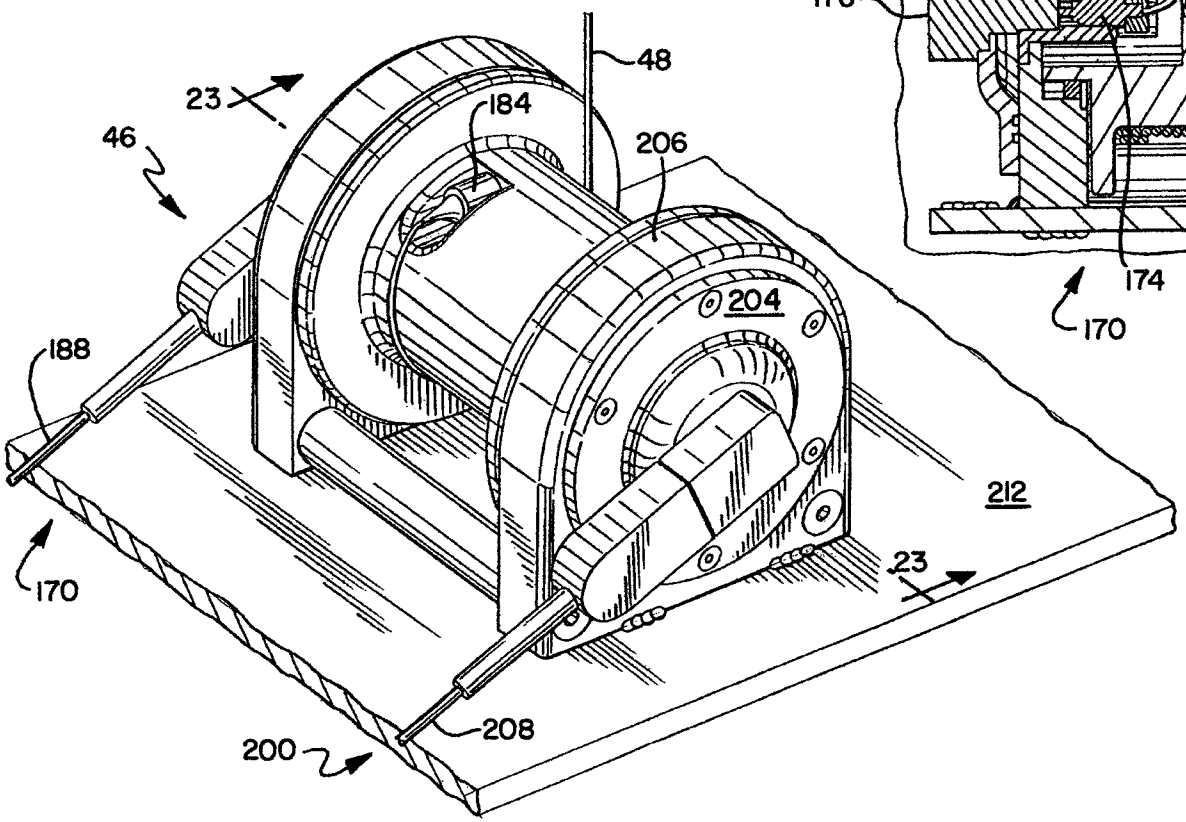
FIG. 22 illustrates an exemplary launch and recovery system usable in connection with the system shown in FIG. 1.

Turning now to FIGS. 22-23, there is shown an exemplary launch in recovery system 46. As shown in the figures, launch and recovery system 46 may include drive system 200 and launch and recovery communication system 170. Drive system 200 may include motor 216, which may be a DC gear motor, for example, for driving drum 210 forward and in reverse to wind and unwind cable system 48 onto and from drum 210. Drive system 200 may further include end cap 204, which may be removable and replaceable to access, for example, motor 216 while maintaining a water-tight seal. Drive system 200 may further include underwater connector 218 for transmitting electrical power along conduit 208 from UUV 20 to motor 216. Drive system 200 may further include end block 206 attached to base plate 212 for securing launch and recovery system 46 to hull segment 42 of towed antenna system 40. Drive system 200 may additionally include one or more bearings 180 and one or more rotary seals 182 to permit drum 210 to rotate relative to end block 206 while maintaining a water-tight seal therebetween.

Launch and recovery communication system 170 of launch and recovery system 46 may be configured for transmitting data signals to and from UUV 20 and towed body 60 and for transmitting electrical power from UUV 20 to towed body 60. Launch and recovery communication system 170 may include slip ring assembly 174 to electrically interface the stationary electrical components of launch and recovery communication system 170 of launch and recovery system 46 to the rotational electrical components of launch and recovery system 46.

Launch and recovery communication system 170 may further include underwater connector 184 for connecting cable system 48 to drum 210 while maintaining a water-tight seal. Launch and recovery communication system 170 may further include one or more bearings 180, and one or more rotary seals 182, to enable drum 210 to rotate relative to end block 186 while maintaining a water-tight seal therebetween.

Launch and recovery communication system 170 may additionally include end cap 178, which may be removable and replaceable to access internal components of launch and recovery communication system 170, such as, for example, slip ring assembly 174. Launch and recovery communication system 170 may also include end block 186, attached to base plate 212 for securing launch and recovery communication system 170 to hull segment 42 of towed antenna system 40. Launch and recovery communication system 170 may further include underwater connector 176 for transitioning cable system 48 from launch and recovery communication system 170 to connect with UUV 20 in a waterproof manner. In one embodiment, cable system 48 exiting underwater connector 176 comprises cable system 188, which connects with UUV 20. In another embodiment, cable system 48 comprises a continuous cable from originating at towed body 60 and terminating at UUV 20.

Launch and recovery system 46 may be made from materials suitable for submersion in salt water environments. In one embodiment, at least some of the components of launch and recovery system 46 are made from a plastic. In another embodiment, at least some of the components of launch and recovery system 46 are made from a composite material.

Figure 24:
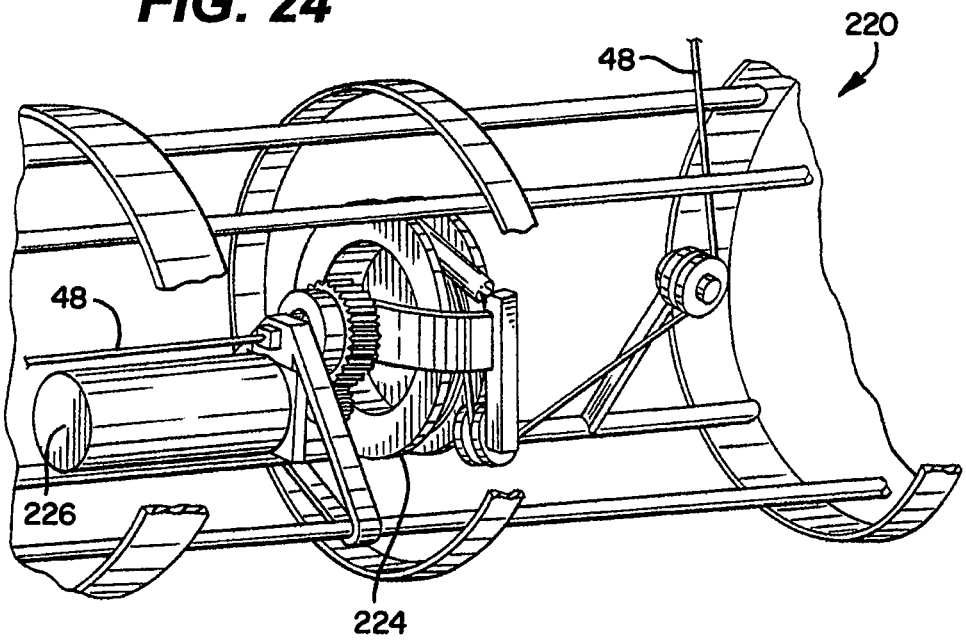
FIG. 24 illustrates an embodiment of a launch and recovery communication system usable in connection with the system shown in FIG. 1.
Figure 25:
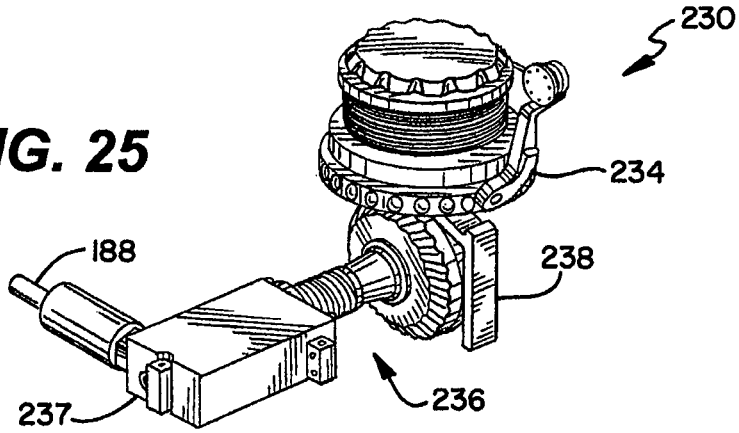
FIG. 25 illustrates an embodiment of a launch and recovery communication system usable in connection with another embodiment of a launch and recovery system.
Figure 26:
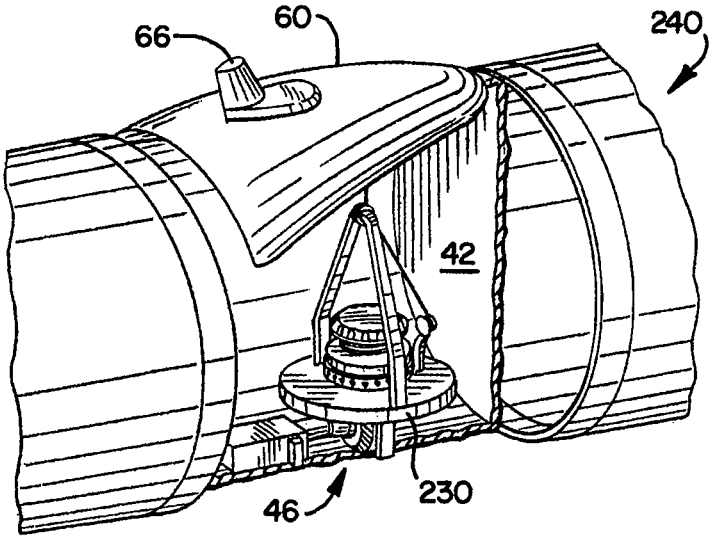
FIG. 26 illustrates another embodiment of a towed antenna system usable in connection with the system shown in FIG. 1.

FIGS. 24-26 illustrate optional embodiments for launch and recovery system 46 to enable cable system 48 to be continuous from towed body 60 to UUV 20 without requiring slip ring assembly 174. FIG. 24, for example, shows launch and recovery communication system 220, including drive system 226, and reel system 224. As shown in FIG. 24, cable system 48 may be wound and unwound from a fixed spool with a bail-type sheave rotating around the spool. In this way, the spool does not turn thereby allowing cable system 48 to remain as one continuous line from towed body 60 to module 32 housing UUV communication system 150 of UUV 20. A spring loaded retainer with foam on the inside may maintain pressure on that portion of cable system 48 that is wound on the fixed spool to keep cable system 48 from loosening and possibly becoming tangled in the event of loss of tension on cable system 48 when towed body 60 is deployed. Reel system 224, as depicted in FIG. 24, may be designed for at least 100 feet of cable system 48 within a spool diameter of approximately 2.5 inches and a drum length of approximately 1 inch axially. Hull segment 42 incorporating launch and recovery communication system 220 may be less than 24 inches long from bulk head to bulk head to adjoining modules 32 with this configuration.

A simulated reel system 224 of launch and recovery communication system 220 was performed by modifying a fishing spool having a spool diameter of approximately 4.5 inches and adding approximately 30 sheet of a fiber optic tow cable, such as, for example, cable 252 or cable 262. A simple bail was fabricated and was manually driven around the stationery spool. The cable was unwound from the spool and then rewound onto the spool during which it was discovered that there was approximately a one-half turn of twist induced in the cable. However, when the cable was fully unwound from the spool, the twist disappeared. Further tests indicated that this behavior was repeatable.

FIG. 25 shows launch and recovery communication system 230 having drive system 236 and reel system 234. Drive system 236 may include motor 237, which may comprise a stepper motor, hydraulic motor, DC rotary actuator, or a modified servo. All of these options are capable of underwater use but their depth ratings may vary. In one embodiment, communication system 230 comprises a modified DA-22 sub servo available from Volz GmbH of Germany. A servo of this type may be designed for travel angles less than 330 degrees, but may easily be modified for continuous rotation as may be required by launch and recovery system 46. The stall torque for the DA-22 sub servo is approximately 410 oz-in and continuous torque is expected to be approximately 230 oz-in, which translates to approximately 6-11 lbs of tension capacity of cable system 48. A DA-22, for example, is approximately 1.75 inch by approximately 2.68 inch by approximately 1.0 inch, is rated to a depth of approximately 100 meters, and is controlled with a common RS 422 or RS 485 interface. Cable system 188 may be connected to motor 237 to transmit data signals to and from towed body 60 and UUV 20 and to transmit power to towed body 60 from UUV 20.

In an embodiment, reel system 234 may be based on, for example, a Zeebaas ZX 27 fishing spool modified by removing the handle and adding coupling 238 for the spool to motor shaft interface. Reel system 234, like reel system 224, may comprise cable system 48 spun around a fixed spool with a bale type sheave rotating around the spool. In this way, cable system 48 may be coiled around the spool without the spool itself turning.

FIG. 26 shows an exemplary towed antenna system 40 incorporating launch and recovery communication system 230 together with another embodiment of towed body 60. As shown in FIG. 26, the relatively small size of launch and recovery system 46 having launch and recovery communication system 230 permits the total length of hull segment 42 to be just longer than the overall length of towed body 60. This is because the small reeling mechanism can fit beneath towed body 60 instead of taking up space behind it.

Figure 27:
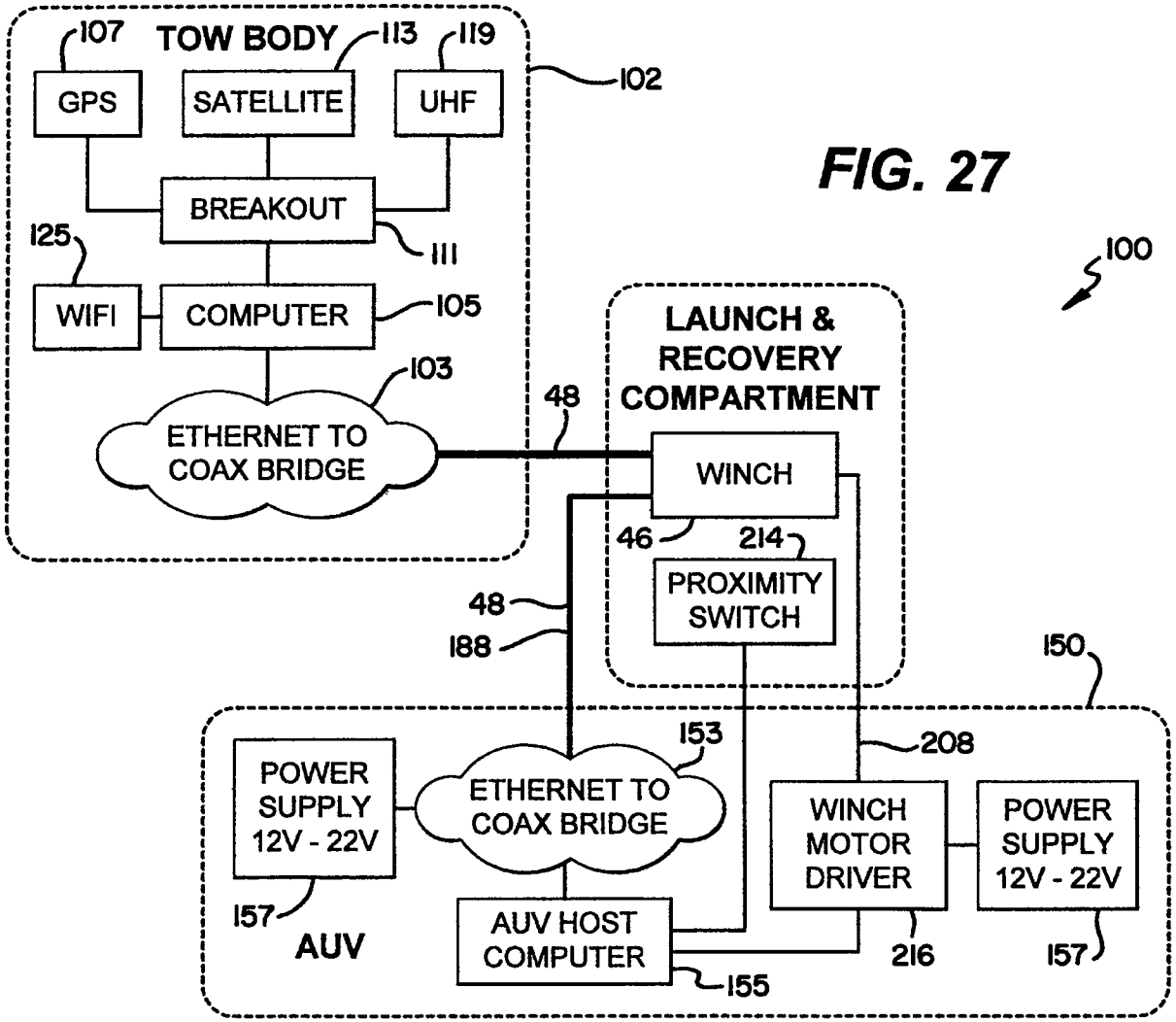
FIG. 27 illustrates a communication system usable in connection with the system shown in FIG. 1.

Turning now to FIG. 27, there is shown an exemplary communication system 100 that is usable in connection with towed antenna system 40 of system 10 for bi-directionally transmitting and receiving data signals to and from one or more remote communication systems to and from UUV 20. Communication system 100 includes towed body communication system 102 and UUV communication system 150. Depending on the configuration of launch and recovery system 46 used in connection with towed antenna system 40, communication system 100 may also include, for example, launch and recovery communication system 170, 220, or 230.

Towed body communication system 102, as shown in FIG. 27, includes computer 105, which may include flash memory, ram memory, and means for permanent data storage, such as a hard drive. Computer 105 may also include a processor as well as various ports and interfaces to connect with peripheral devices and antennas. For example, computer 105 may include Bluetooth, USB, Wi-Fi, cellular, satellite, IEEE UART, and $I^2C$ ports and interfaces. Computer 105 may comprise an operating system for carrying out computer instructions, such as Linux, and operate on one or more wired or wireless networks, such as an intranet and the Internet. Towed body communication system 102 may use one or more encryption methods for privately communicating data signals to and from UUV 20 and to and from the at least one remote communication system.

As shown in FIG. 27, computer 105 is connected to Wi-Fi communication system 125, GPS communication system 107, satellite communication system 113, and RF communication system 119 through, for example, interface 111. To bi-directionally transmit and receive data signals to and from towed antenna system 40 to and from one or more remote communication systems via a Wi-Fi connection, Wi-Fi communication system 125 of towed antenna system 40 may include a Wi-Fi antenna connected to a Wi-Fi transceiver. The Wi-Fi transceiver may be connected to computer 105 using, for example, a USB, serial, or Ethernet cable. The Wi-Fi transceiver may alternatively be integrated with or directly connected to computer 105.

To receive GPS data signals, GPS communication system 107 of towed antenna system 40 may include a GPS antenna connected to a GPS receiver. GPS receiver of GPS communication system 107 may be connected to computer 105 using, for example, a USB, serial, or Ethernet cable. The GPS receiver may alternatively be integrated with or directly connected to computer 105.

To bi-directionally transmit and receive data signals to and from towed antenna system 40 to and from one or more remote communication systems via a satellite connection, satellite communication system 113 of towed antenna system 40 may include a satellite antenna connected to a satellite transceiver. The satellite transceiver of satellite communication system 113 may be connected to computer 105 via a serial cable, or a USB cable, for example. The satellite transceiver may alternatively be integrated with or directly connected to computer 105. The satellite antenna and the GPS antenna may comprise a single antenna configured to receive GPS signals and to transmit and receive data signals to and from one or more satellites. Similarly, the satellite transceiver and the GPS receiver may be configured as part of a single module having both satellite and GPS communication capabilities.

To bi-directionally transmit and receive data signals to and from towed antenna system 40 to and from one or more remote communication systems via an RF connection, RF communication system 119 of towed antenna system 40 may include an RF antenna connected to an RF transceiver. The RF antenna may be configured to receive and transmit, for example, UHF radio signals, including spread spectrum radio signals, and cellular communication signals.

As shown in FIG. 27, computer 105 may be connected to Ethernet to Coax bridge 103 using, for example, an Ethernet cable, to convert the data signals from an Ethernet-based system to cable system 48 comprising, for example, mini coax cable 282.

As further shown in FIG. 27, cable system 48 connects towed body communication system 102 with launch and recovery system 46. Cable system 48 or, for example, cable system 188, connects launch and recovery system 46 with computer 155 of UUV 20 contained in a module 32 of UUV 20.

Cable system 48 (or cable system 188, for example) may be connected with Ethernet to Coax bridge 153 of UUV communication system 150 to convert the data signals to and from an Ethernet-based system to or from a coax cable system, such as, for example, cable 282. Ethernet to Coax bridge 153 may be connected with computer 155 either directly or, for example, using an Ethernet cable.

Also shown in FIG. 27 is UUV power supply 157 which may supply UUV 20 electrical power to launch and recovery system 46 to power, for example, drive system 200. Similarly, electrical power from UUV 20 may be supplied from UUV 20 through cable system 48 through, for example, launch and recovery communication system 170 of launch and recovery system 46 and ultimately to towed body 60 through cable system 48. Alternatively, towed body 60 may house and carry its own power supply, such as a battery, to power computer 105 and all peripheral components in towed body 60.

Computer 155 of UUV 20 may command launch and recovery system 46 to deploy and retrieve towed body 60 according to pre-programmed commands stored in computer 155. UUV 20 may transmit and receive communication signals to and from one or more remote communication systems using towed antenna system 40 to do so.

Data signals to and from the remote communication system with towed antenna system 40 may be transmitted to and from computer 155 of UUV 20 in real time. Alternatively or in addition to, data signals to and from the remote communication system with towed antenna system 40 may be stored in memory associated with computer 105. In this way, data signals from computer 155 of UUV 20 may be stored in memory associated with computer 105 for later transmission to the one or more remote communication systems. Similarly, data signals received from the one or more remote communication systems by towed antenna system 40 may be stored in memory associated with computer 105 for later transmission to computer 155 of UUV 20.

In an embodiment cable system 48 comprises a mini coax-type cable, such as cable 282, a Gumstix Verdex Pro XM4 or a Gumstix Verdex Pro XL6P may be employed. These devices, which are available at www.gumstix.com, are each a complete computer system that can accept multiple serial devices, has both wired and wireless Ethernet ports and runs the Linux operating system. It requires relatively low power to operate and it is literally the size of a stick of gum.

The Ethernet protocol is full duplex and high speed, but typically requires four conductor wires to transport data signals. To employ a two-wire protocol to permit cable system 48 to require only two conductors to transport data signals, an E-Linx Ethernet Extender may be employ. An E-Linx Ethernet Extender, which is available at www.www.bb-elec.com, permits Ethernet to operate over two wires and up to 50 MBPS for cable runs up to approximately 980 feet. An E-Linx Ethernet Extender may auto-negotiate its speed to maintain data integrity, eliminating the risk of data loss. In one embodiment, a Gumstix Verdex Pro XM4 may be connected to an E-Linx Ethernet Extender via the Ethernet port and housed in towed body 60. Within UUV 20, another E-Linx Ethernet Extender may be connected to computer 155 via its Ethernet port. A software bridge may be written to transport data signals between one or more serial ports and the Ethernet port.

In an embodiment cable system 48 comprises a fiber optic-type cable, such as cable 252, a PRIZM Ultimate USB may be employed to transmit and receive data signals along a single fiber. The PRIZM Ultimate USB, which is available at www-.moog.com, offers bi-directional fiber optic transmission of, for example, video and data signals, over a single fiber. The PRIZM Ultimate USB is designed for underwater applications, and includes a 4 port USB 1.1 hub. This device may require up to 7.5 watts of power to operate, which may or may not be significant depending on the power source availability in UUV 20 or in towed body 60 and the power transmission properties of the chosen cable system 40. Two boards may be needed for the system to be complete: one board for each end of cable system 48.

Another option for use in connection with cable system 48 comprising a fiber optic-type cable is the AXFT-1621 single fiber, bi-directional receptacle/transceiver. This device, which is available from Axcen Photonics Corp. at www.axcen.com.tw, can transmit and receive data signals at the serial TTL level enabling compatibility with virtually any type of communications hardware. A second multiplexer board may be needed to combine data signals to and from Wi-Fi communication system 125, GPS communication system 107, satellite communication system 113, and RF communication system 119. The AXFT-1621 transceiver may incorporate additional multiplexers and provide breakouts for communications ports to attach additional communication modules, but may require custom supporting circuitry in order to function in towed antenna system 40.

In one embodiment, the Wi-Fi transceiver of Wi-Fi communication system 125 may be based on the RTL 8187B chipset found in, for example, a Trendnet TEW-424 UB Wi-Fi module, which is available at www.trendnet.com. This module operates with the standard IEEE 802.11g protocol, which may provide a range of approximately 100 meters for Wi-Fi communication. In addition, this particular module may connect directly into a USB port or a USB adaptor to computer 105, and is configured together with a Wi-Fi antenna.

Figure 28:
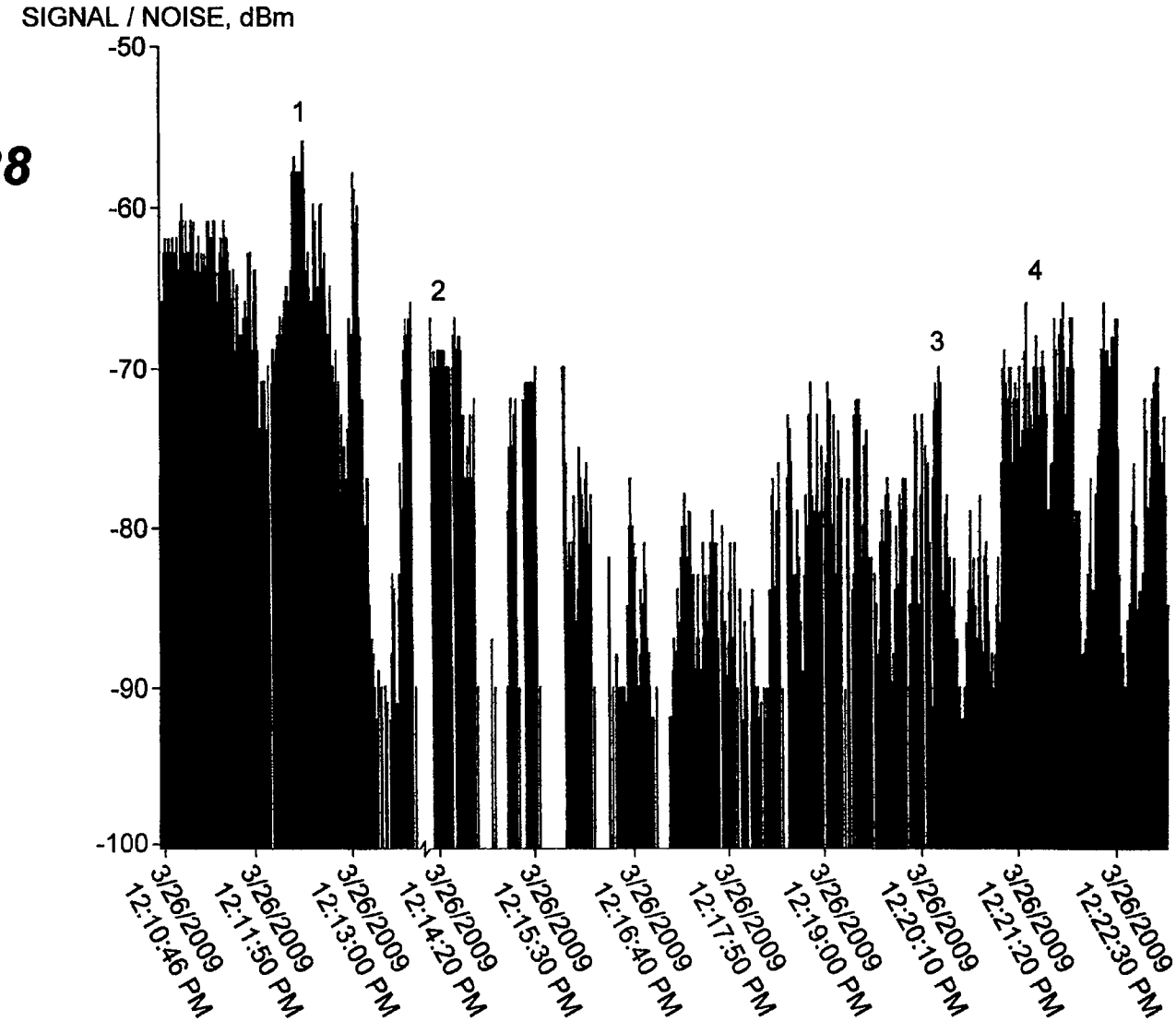
FIG. 28 illustrates the results of a test involving an embodiment of a communication system usable in connection with the system shown in FIG. 1.

In a test using this module for Wi-Fi communications, a simulated towed body 60 was placed in the water and a battery powered Wi-Fi router was carried approximately 12 feet above the water at various distances from the simulated towed body 60 carrying the Trendnet TEW-424 UB Wi-Fi module. FIG. 28 shows the signal to noise ratio for the signal that the handheld Wi-Fi router received from the Wi-Fi module.

In addition, sample ping results while towing the simulated towed body 60 at site 4 shown in FIG. 28 shows that latency is steady and is at acceptable levels as follows:

Reply from 192.168.2.1: bytes=32 time=54 ms TTL=64
Reply from 192.168.2.1: bytes=32 time=54 ms TTL=64
Reply from 192.168.2.1: bytes=32 time=53 ms TTL=64
Reply from 192.168.2.1: bytes=32 time=57 ms TTL=64
Reply from 192.168.2.1: bytes=32 time=53 ms TTL=64
Reply from 192.168.2.1: bytes=32 time=53 ms TTL=64
Reply from 192.168.2.1: bytes=32 time=54 ms TTL=64
Reply from 192.168.2.1: bytes=32 time=53 ms TTL=64
Reply from 192.168.2.1: bytes=32 time=54 ms TTL=64
Reply from 192.168.2.1: bytes=32 time=54 ms TTL=64
Reply from 192.168.2.1: bytes=32 time=53 ms TTL=64
Reply from 192.168.2.1: bytes=32 time=53 ms TTL=64
Reply from 192.168.2.1: bytes=32 time=54 ms TTL=64
Reply from 192.168.2.1: bytes=32 time=53 ms TTL=64
Reply from 192.168.2.1: bytes=32 time=54 ms TTL=64
Reply from 192.168.2.1: bytes=32 time=55 ms TTL=64
Reply from 192.168.2.1: bytes=32 time=53 ms TTL=64
Reply from 192.168.2.1: bytes=32 time=54 ms TTL=64
Reply from 192.168.2.1: bytes=32 time=53 ms TTL=64
Reply from 192.168.2.1: bytes=32 time=53 ms TTL=64
Reply from 192.168.2.1: bytes=32 time=53 ms TTL=64
Reply from 192.168.2.1: bytes=32 time=55 ms TTL=64
Reply from 192.168.2.1: bytes=32 time=53 ms TTL=64

In another embodiment, a NetWi-FiMicroSD Add-on board may be added to or be integrated with a Gumstix microcontroller to form a Wi-Fi transceiver. The NetWi-FiMicroSD, which is available at www.gumstix.com, features a 10/100 wired Ethernet port and a Marvell 88W8385 Wi-Fi transceiver module supporting IEEE 802.11b/g. This device also includes a MicroSD slot allowing up to 4 GB of flash memory to be used by the Gumstix microcontroller for logging or other file storage needs.

In an embodiment in which cable system 48 comprises a fiber optic-type cable, the Wi-Fi transceiver includes a WL-USB-RSMAP, which is available at www.jefatech.com. This module includes an SMA antenna jack to permit its use with a Wi-Fi amplifier to increase range.

In another embodiment, a Wi-Fi amplifier is connected between the Wi-Fi transceiver and the Wi-Fi antenna to amplify data signals received by and transmitted out from the Wi-Fi antenna. In an embodiment, the Wi-Fi amplifier comprises an RF-Linx 2400 CAE-1W, which is available at www.rflinx.com. This amplifier is a 1-watt amplifier, which uses automatic gain control to only use power when it needs to send or receive data, thereby conserving energy. Simulation testing has revealed that a Wi-Fi communications connection using this amplifier may result in a range of up to 1 mile over open water.

Turning to hardware options for GPS reception, in one embodiment, the GPS receiver of towed antenna system 40 includes one of the NovAtel OEMV 1/1G line of GPS receivers, which are available at www.novatel.com. The NovAtel OEMV 1/1G line offers centimeter-level positioning accuracy with RTK corrections and 2 meter or greater accuracy as well as high reliability using satellites in the GLONASS network. With 48+ satellites in the combined GPS-GLONASS networks, performance in high seas may be expected to be improved as more satellites are visible in the non-blocked portions of the sky. The OEMV-1 supports both RS232 and USB interfaces.

In one embodiment, the GPS antenna includes a PCtel WS3951-HR, which is available at www.canalgeomatics.com. This antenna provides high gain, low noise, low power and small size. It also has a high rejection, dual SAW filter, which is expected to decrease the risk of interference with any nearby Wi-Fi antenna.

In another embodiment, the GPS receiver includes a GlobalSat SiRF III transceiver module, which may track up to approximately 20 GPS satellites simultaneously. Data from this transceiver module is output in standard NMEA 0183 format over, for example, a USB interface.

When testing a simulated towed body 60 carrying this particular GPS transceiver module, the following results showed that the transceiver unit had a successful communications connection with one or more GPS satellites:

$GPGGA,165837.000,4135.1941,N,07056.7651,W,2,11,0.9,6.4,M,−34.4,M,0.8,0000*4F
$GPGSA,A,3,08,10,09,27,26,18,15,24,21,29,02,,1.3,0.9,1.0*38
$GPRMC,165837.000,A,4135.1941,N,07056.7651,W,0.19,175.92,260309,,*1E
$GPGGA,165838.000,4135.1941,N,07056.7651,W,2,11,0.9,6.4,M,−34.4,M,0.8,0000*40
$GPGSA,A,3,08,10,09,27,26,18,15,24,21,29,02,,1.3,0.9,1.0*38
$GPRMC,165838.000,A,4135.1941,N,07056.7651,W,0.07,65.49,260309,,*28
$GPGGA,165839.000,4135.1941,N,07056.7651,W,2,11,0.9,6.4,M,−34.4,M, 0.8,0000*41
$GPGSA,A,3,08,10,09,27,26,18,15,24,21,29,02,,1.3,0.9,1.0*38
$GPRMC,165839.000,A,4135.1941,N,07056.7651,W,0.06,202.70,260309,,*11
$GPGGA,165840.000,4135.1941,N,07056.7650,W,2,11,0.9,6.5,M,−34.4,M, 1.8,0000*4E

When the unit lost a GPS connection, the sentences had lots of empty fields like this.

$GPGGA, 165837.000,,,,,0,0,99.99,,,,,,*5F
$GPRMC,165837.000,A,,,,,,,,N,,,,,,,,,W,0.19,,,,,,260309,,*1E

During testing, it was also discovered that the GPS communication connection may be lost or interrupted when the GPS antenna 109 in the simulated towed body 60 is submerged more than 1 inch below the water. However, GPS signal reacquisition occurred in a matter of approximately 2 seconds once the simulated towed body 60 returned to the surface. In a test involving a simulated towed body 60 configured with antenna housing 66 comprising a relatively short dorsal extension extending from top surface 64 (see, e.g., the exemplary towed body 60 shown in FIG. 26), the Wi-Fi transceiver seemed to lose its effectiveness at approximately 225 feet from the simulated towed body 60. To mitigate the possibility of incurring connectivity issues due to, for example, submersion, water spray from waves, or line-of-sight blockage as may occur from a wave, system 10 may include, for example, extending the height of antenna housing 66 and therefore any antennas therein, operating towed body 60 in calm seas, and having a number of available remote communication systems with which to make at least one communication connection. Components of system 10 may also include computer hardware and/or software designed to communicate data signals in packets to maximize available connection opportunities.

Turning to options to communicate with one or more satellites, in one embodiment, the satellite transceiver of towed antenna system 40 includes the Iridium 9601, which is available at www.iridium.com. The Iridium 9601 transceiver is an OEM solution designed for embedded systems. It offers global coverage for the short-burst-data (SBD) service. The SBD service allows 340 bytes per message which is expected to work well for "phone-home" messages containing GPS coordinates and simple status updates from UUV 20. The Iridium 9601 interfaces with RS232 and uses an L-band antenna.

Figure 29:
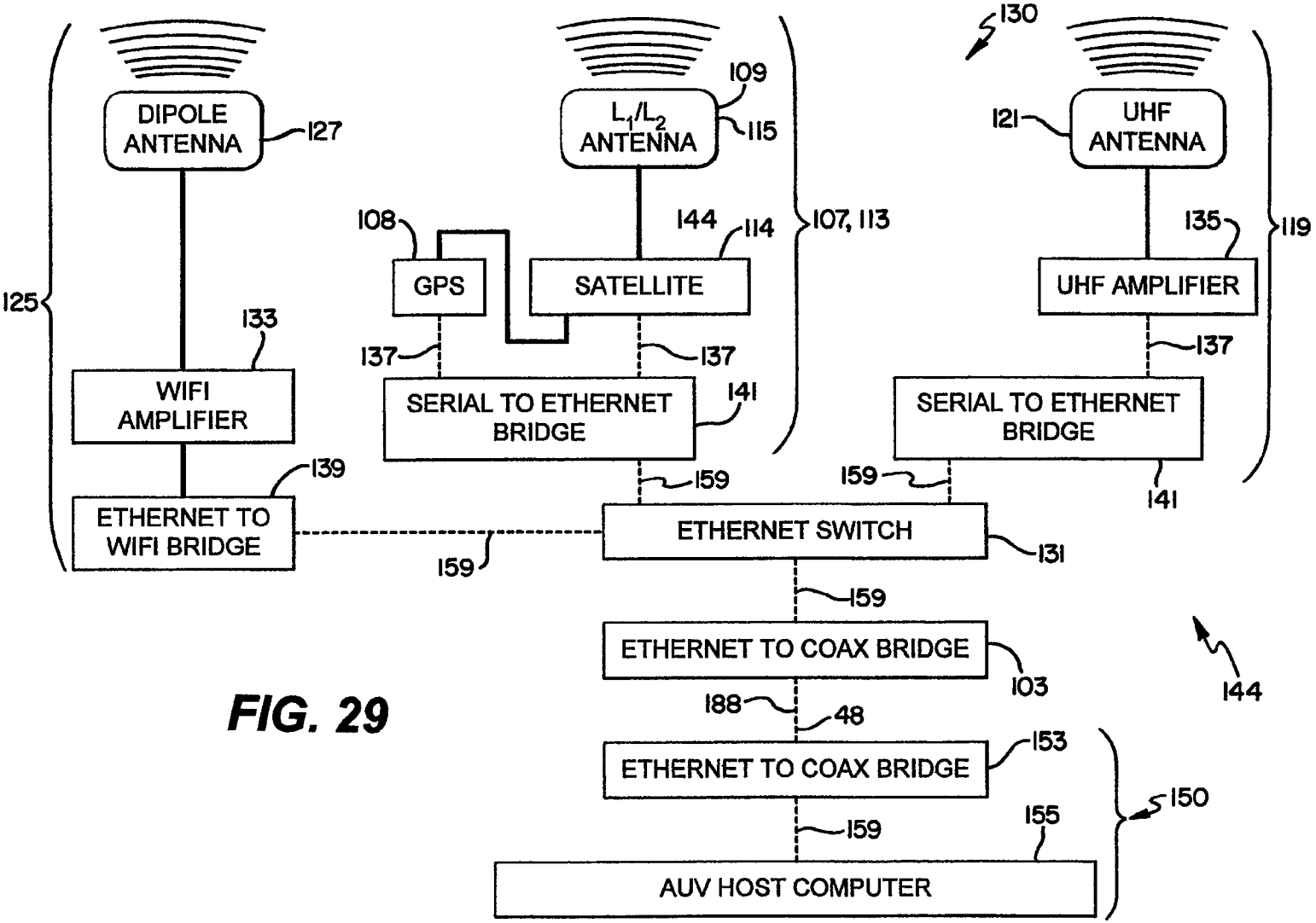
FIG. 29 illustrates another embodiment of a communication system usable in connection with the system shown in FIG. 1.

Turning now to FIG. 29, there is shown another exemplary communication system 130 that is usable in connection with towed antenna system 40 of system 10 for bi-directionally transmitting and receiving data signals to and from one or more remote communication systems to and from UUV 20. Communication system 130 includes towed body communication system 144 and UUV communication system 150. Towed body communication system 144 includes one or more of, for example, Wi-Fi communication system 125, GPS communication system 107, satellite communication system 113, and RF communication system 119.

Towed body communication system 144 may include Ethernet switch 131 to transmit and receive data signals to and from Wi-Fi communication system 125, GPS communication system 107, satellite communication system 113, and RF communication system 119 to and from UUV communication system 150 of UUV 20. Ethernet switch 131 of towed body communication system 144 may be connected to Ethernet to Coax bridge 103 via, for example, Ethernet cable 159, to convert the data signals from an Ethernet-based system to cable system 48 comprising, for example, mini coax cable 282. Ethernet switch 131 may alternatively be integrated with Ethernet to Coax bridge 103 thereby simplifying connectivity with Wi-Fi communication system 125, GPS communication system 107, satellite communication system 113, and RF communication system 119. Depending on the configuration of launch and recovery system 46 used in connection with towed antenna system 40, towed body communication system 144 may also include, for example, launch and recovery communication system 170, 220, or 230.

To bi-directionally transmit and receive data signals to and from towed antenna system 40 to and from one or more remote communication systems via a Wi-Fi connection, Wi-Fi communication system 125 of towed antenna system 40 may include Wi-Fi antenna 127 connected to Wi-Fi amplifier 133 for amplifying data signals received by and/or transmitted out from Wi-Fi antenna 127. In one embodiment, Wi-Fi communication system 125 includes a Wi-Fi transceiver connected to Wi-Fi amplifier 133. The Wi-Fi transceiver may be connected to Ethernet to Wi-Fi bridge 139, which is usable for converting data signals to and from an Ethernet-based system. In another embodiment, UUV communication system 150 of UUV 20 includes a Wi-Fi transceiver for bi-directionally transmitting and receiving data signals to and from one or more remote communication systems to and from UUV 20 via a Wi-Fi connection.

As shown in the embodiment of FIG. 29, Wi-Fi amplifier 133 is connected to Ethernet to Wi-Fi bridge 139. Ethernet to Wi-Fi bridge 139 may be connected to Ethernet switch 131 using, for example, Ethernet cable 159. As described above, Ethernet switch 131 may be connected to Ethernet to Coax bridge 103 using, for example, Ethernet cable 159. Alternatively, Ethernet to Wi-Fi bridge 139 may be integrated with Ethernet switch 131 and/or Ethernet to Coax bridge 103.

To bi-directionally transmit and receive data signals to and from towed antenna system 40 to and from one or more remote communication systems via a satellite connection, satellite communication system 113 of towed antenna system 40 may include satellite antenna 115 connected to satellite transceiver 114. Satellite transceiver 114 may be connected to Serial to Ethernet bridge 141 using, for example, serial cable 137. Serial to Ethernet bridge 141 may be connected to Ethernet switch 131 using, for example, Ethernet cable 159. Alternatively, Serial to Ethernet bridge 141 of satellite communication system 113 may be integrated with Ethernet switch 131 and/or Ethernet to Coax bridge 103.

To receive GPS data signals, GPS communication system 107 of towed antenna system 40 may include GPS antenna 109 connected to GPS receiver 108. GPS receiver 108 may be connected to Serial to Ethernet bridge 141 using, for example, serial cable 137. As shown in FIG. 29, GPS receiver 108 may alternatively be integrated with or directly connected with satellite transceiver 114 to form a single module having both satellite and GPS communication capabilities. In addition, satellite antenna 115 and GPS antenna 109 may comprise a single antenna configured to receive GPS signals and to transmit and receive data signals to and from one or more satellites.

To bi-directionally transmit and receive data signals via an RF connection to and from towed antenna system 40 to and from one or more remote communication systems via an RF connection, RF communication system 119 of towed antenna system 40 may include RF antenna 121 connected to RF amplifier 135 for amplifying data signals received by and transmitted out from RF antenna 121. In one embodiment, RF communication system 119 includes an RF transceiver connected to RF amplifier 135. The RF transceiver may be connected to Serial to Ethernet bridge 141, which is usable for converting data signals to and from an Ethernet based system. In another embodiment, UUV communication system 150 of UUV 20 includes an RF transceiver for bi-directionally transmitting and receiving data signals to and from one or more remote communication systems to and from UUV 20 via an RF connection. The RF transceiver or RF amplifier 135 may be connected to Serial to Ethernet bridge 141 using, for example, serial cable 137.

As shown in the embodiment of FIG. 29, RF amplifier 135 is connected to Serial to Ethernet bridge 141 using, for example, serial cable 137. Serial to Ethernet bridge 141 may be connected to Ethernet switch 131 using, for example, Ethernet cable 159. As described above, Ethernet switch 131 may be connected to Ethernet to Coax bridge 103 using, for example, Ethernet cable 159. Alternatively, Serial to Ethernet bridge 141 of RF communication system 119 may be integrated with Ethernet switch 131 and/or Ethernet to Coax bridge 103.

Cable system 48 connects towed body communication system 144 with launch and recovery system 46. Cable system 48 or, for example, cable system 188, connects launch and recovery system 46 with computer 155 of UUV 20 contained in one of modules 32 of UUV 20.

Cable system 48 (or cable system 188, for example) may be connected with Ethernet to Coax bridge 153 of UUV communication system 150 to convert the data signals to and from an Ethernet-based system to or from a coax cable system, such as, for example, cable 282. Ethernet to Coax bridge 153 may be connected with computer 155 using, for example, Ethernet cable 159. Alternatively, Ethernet to Coax bridge 153 may be integrated with computer 155.

Electrical power from UUV 20 may be supplied through cable system 48 (or cable system 188, for example) through, for example, launch and recovery communication system 170 of launch and recovery system 46, and ultimately to towed body 60 through cable system 48. Alternatively, towed body 60 may house and carry its own power supply, such as a battery, to electrically power computer 105 and all peripheral computer and communication components and all servo motors in towed body 60.

Computer 155 of UUV 20 may command launch and recovery system 46 to deploy and retrieve towed body 60 according to pre-programmed commands stored in computer 155. UUV 20 may bi-directionally transmit and receive communication signals to and from one or more remote communication systems, in parallel or in series, using towed antenna system 40 to do so.

Data signals to and from the one or more remote communication system with towed antenna system 40 may be transmitted to and from computer 155 of UUV 20 in real time. Alternatively or in addition to, data signals to and from the one or more remote communication system with towed antenna system 40 may be stored in memory associated with computer 105. In this way, data signals from computer 155 of UUV 20 may be stored in memory associated with computer 105 for later transmission to the one or more remote communication systems. Similarly, data signals received from the one or more remote communication system by towed antenna system 40 may be stored in memory associated with computer 105 for later transmission to computer 155 of UUV 20.

In one embodiment, Ethernet to Wi-Fi bridge 139 comprises a Quatech Airborne Enterprise Class Ethernet bridge module, which is available at www.quatech.com. In another embodiment, GPS receiver 108 of GPS communication system 107 comprises, for example, a Hemisphere Crescent OEM module, which is available at www.hemispheregps.com. In a further embodiment, a GPS antenna 109 comprises a Wi-Sys WS3951-HR No-Interference Embedded GPS Antenna, which is available at www.antenna.com. In yet another embodiment, Serial to Ethernet bridge 141 comprises a Moxa NE-4100 Embedded Serial Device Server, which is available at www.moxa.com. In one embodiment, Ethernet switch 131 comprises a Moxa EOM-104 4-Port Embedded Managed Ethernet Switch, which is also available at www.moxa.com. In another embodiment, RF amplifier 135 comprises a Freewave MM2 900 MHz Spread Spectrum UHF Radio, which is available at www.freewave.com. In one embodiment, Ethernet to Coax bridge 103 comprises, for example, an Amplicon UCA-6120 Intelligent Ethernet to Coax Adaptor, which is available at www.amplicon.com. In another embodiment, satellite transceiver 114 of satellite communication system 113 comprises, for example, an Iridium 9602 SBD transceiver, which is available at www.iridium.com.

Typical UUV missions can last up to 18 hours in duration, during which towed antenna system 40 may be tasked with providing up to 50 deployments, each lasting from approximately 3 to approximately 8 minutes. In one embodiment, transmission and reception of data signals via satellite draws up to approximately 20 watts of power. The resulting energy capacity needed to operate an embodiment of towed antenna system 40 is approximately 133 watt-hours of energy. Therefore, an exemplary towed antenna system 40 may either require a battery with 133 watt-hour capacity, or cable system 48 must be sized to transmit approximately 20 watts from UUV 20's own power supply.

In an embodiment involving cable system 48 comprising a fiber optic-type cable, to transmit electrical power over fiber, a JDSU Photovoltaic power converter may be used. This unit delivers 0.5 watts of energy at voltages ranging between 2 and 12 volts DC. Although this may not be enough energy to simultaneously power all of the electrical devices located in towed body 60, this device may nevertheless be used to trickle charge a battery housed in towed body 60 between deployments.

In one embodiment having the hardware listed below for cable system 48 comprising a fiber optic-type cable, and assuming a deployment duration of approximately 8 minutes for towed antenna system 40, each device may be expected to demand the following amounts of electrical energy:

TABLE 1

Fiber Optic Power Budget

| Hardware | Voltage (VDC) | Amperage (mA) | Power (W) | W-hrs |
|---|---|---|---|---|
| NovAtel GPS | 3.3 | 300 | 1 | 0.133 |
| WL-USB-RSMAP WiFi | 5 | 580 | 2.9 | 0.39 |
| Ultimate USB | 5.0 | 1500 | 7.5 | 1.0 |
| 9601 Iridium | 5.0 | 350 | 1.75 | 0.23 |
| PCtel Antenna | 3.3 | 7.5 | .025 | 0.003 |
| Total | | 2738 | 13.18 | 1.76 |

To accommodate these electrical loads, in one embodiment, a 7.4 V Li—Po battery having 875 mAh of capacity may be employed. A battery of this type is expected to weigh only 1.6 oz. and would provide 6.5 W-hrs, which is expected to be more than three times the needed capacity.

A power control board may be used to regulate the charging of the battery and distribution of power to the different system components. If the Axcen AXFT-1621 fiber optic module were included in the system, charging circuitry could be incorporated into its circuit board as well. Otherwise, a small PCB incorporating a single chip charging regulator may be built.

In an embodiment having the hardware listed below for cable system 48 comprising a mini-coax-type cable, and assuming a deployment duration of approximately 8 minutes for towed antenna system 40, each device may be expected to demand the following amounts of electrical energy:

TABLE 2

Coax Power Budget

| Hardware | Voltage (VDC) | Amperage (mA) | Power (W) |
|---|---|---|---|
| NovAtel GPS | 3.3 | 300 | 1 |
| Gumstix | 5 | 300 | 1.5 |
| NetWifiMicroSD | 5 | 200 | 1 |
| 9601 Iridium | 5.0 | 350 | 1.75 |

TABLE 2-continued

| Coax Power Budget | | | |
|---|---|---|---|
| Hardware | Voltage (VDC) | Amperage (mA) | Power (W) |
| PCtel Antenna | 3.3 | 7.5 | .025 |
| E-Linx Ethernet Ext. | 12 | 200 | 2.4 |
| Total | | 1357.5 | 7.7 |

In this embodiment, the maximum current required is therefore approximately 1.36 amps. Taking, for example, cable 282, which may be rated to transmit only approximately 0.2 amps, the voltage may need to be stepped up to approximately 38.5 volts to provide enough power to system components. A DC-DC converter may be employed to step the voltage down to any level required by any electrical component of towed antenna system 40. In addition, a passive filter located in towed body 60 may be employed to separate out the DC power from any data signals.

While specific embodiments of the invention have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

What is claimed is:

1. A towable antenna system for an unmanned underwater vehicle (UUV), comprising:

a launch and recovery system securable to the UUV;

a towable body having an outer surface profile to substantially conform with an outer surface profile of the UUV, the towable body releasably attached to the UUV in a first position, a receptacle formed in the UUV that permits the towable body to engage the receptacle in the first position, the receptacle configured to receive an underside portion of the towable body including a keel and rudder portions such that when the towable body is in the first position the outer surface profile of the towable body and the outer surface profile of the UUV adjacent to the towable body are substantially flush relative to one another to minimize fluid dynamic drag during operation underwater;

a cable connecting the towable body to the launch and recovery system when the towable body is deployed from the UUV in a second position, the cable operable for transmitting data signals between the towable body and the UUV, the towable body being maneuverable with the rudder when deployed from the UUV; and wherein a communication apparatus and an antenna are operably disposed with the towable body to communicate with at least one remote communication system when the towable body is in the second position.

2. The system of claim 1, wherein the towable body is at the surface of the water when the towable body is in the second position.

3. The system of claim 1, wherein the towable body is near the surface of the water when the towable body is in the second position.

4. The system of claim 1, wherein the towable body is on the surface of the water when the towable body is in the second position.

5. The system of claim 1, wherein the at least one remote communication system comprises at least one of a GPS communication system, a satellite communication system, a Wi-Fi communication system, and an RF communication system.

6. The system of claim 1, wherein the towable antenna system further includes a hull segment removably connected with at least one adjoining hull segment of the UUV for housing the launch and recovery system and the towable body aboard the UUV.

7. The system of claim 1, wherein the cable transmits electrical power to the towable body from the UUV.

8. A towable body for an underwater vehicle, comprising:

a top section comprising at least one antenna for communicating with at least one remote communication system a bottom section connected to the top section, the bottom section comprising a cavity having at least one communication system removably housed therein for communicating with the at least one remote communication system through the at least one antenna and for communicating with the underwater vehicle, the bottom section having a keel and rudder extending therefrom; and wherein the towable body is carried in direct contact with the underwater vehicle in a non-deployed position such that the keel and rudder are nested in a receptacle having an inverse shape to the bottom section of the towable body and launched away from the underwater vehicle toward a surface of the water in the deployed position.

9. The apparatus of claim 8, wherein the top section comprises a profile that approximately conforms with at least a portion of an outer profile of the underwater vehicle when the towable body is in a stowed position relative to the underwater vehicle.

10. The apparatus of claim 8, further including an antenna housing extending from a top surface of the top section and housing the at least one antenna to assist the at least one antenna in acquiring and maintaining at least one communication link with the at least one remote communication system while the towable body is at or near the surface of the water and while the underwater vehicle is submerged under the surface of the water.

11. The apparatus of claim 8, wherein the rudder is locked in a fixed position relative to the towable body.

12. The apparatus of claim 8, wherein at least a portion of the rudder is movable side to side via at least one servo motor.

13. The apparatus of claim 8, wherein the towable body is buoyant.

14. The apparatus of claim 8, wherein the towable body comprises a hydrodynamic lift to drag ratio greater than approximately 1.0 to enable the towable body to rise to the surface of the water when deployed from the underwater vehicle.

15. The apparatus of claim 8, wherein the towable body comprises a circumferentially swept airfoil cross section.

16. The apparatus of claim 8, wherein the at least one remote communication system comprises at least one of a GPS communication system, a satellite communication system, a Wi-Fi communication system, and an RF communication system.

17. The apparatus of claim 8, wherein the top section comprises an aperture covered by a removably replaceable cap for providing access to the cavity of the towable body.

18. The apparatus of claim 8, wherein the bottom section and the top section are separable and recombinable.

19. The apparatus of claim 8, wherein the bottom section is integrally formed with the top section.

20. A communication system for use with an unmanned underwater vehicle (UUV), comprising:

a towable body connected to the UUV in a non-deployed configuration;

a towable antenna system with the towable body;

a drive system for retrievably deploying the towable body to and from the UUV, wherein the towable body is maneuverable with a rudder connected to the towable body when deployed from the UUV; and a launch and recovery communication system connected to the drive system for transmitting electrical power to the antenna system and transmitting communication data signals between the towable antenna system, the UUV, and an external communication system, wherein the launch and recovery communication system is operable below the surface of the water and the antenna system is operable when deployed proximate the surface of the water.

21. The apparatus of claim 20, wherein the drive system comprises an electric motor operable on commands received from the UUV or the towable antenna system to deploy and retrieve the towable antenna system from and to the UUV and to and from the surface of the water.

22. The apparatus of claim 21, wherein the drive system comprises an end block releasably connected to a baseplate, the end block forming a mount for the electric motor.

23. The apparatus of claim 22, wherein the drive system comprises an end cap connected to the end block for forming a water-tight seal therebetween.

24. The apparatus of claim 23, wherein the drive system comprises a connector for connecting the drive system to a power source of the UUV, the connector forming a water-tight seal with the end cap.

25. The apparatus of claim 20, wherein the launch and recovery communication system comprises a slip ring assembly for communicating data signals to and from the towable antenna system and the UUV and for transmitting the electrical power from the UUV to the towable antenna system.

26. The apparatus of claim 25, wherein the launch and recovery communication system comprises an end block releasably connected to a baseplate, the end block forming a mount for the slip ring assembly.

27. The apparatus of claim 26, wherein the launch and recovery communication system comprises an end cap connected to the end block for forming a water-tight seal therebetween.

28. The apparatus of claim 27, wherein the launch and recovery communication system comprises a connector for connecting the launch and recovery communication system to a communication system of the UUV, the connector forming a water-tight seal with the second end cap.

29. The apparatus of claim 20, further comprising a drum driven by the drive system, the drum configured to reel and unreel a cable thereon, the cable being connectable to the launch and recovery communication system on one end and to the towable antenna system on the other end, the cable being configured for transmitting electrical power from a power source in the UUV to the towable antenna system and for transporting data signals between the UUV and the towable antenna system.

30. A system for an underwater vessel comprising:

a towable body having a hydrodynamic shape structured to generate a lift at a towing velocity to cause the towable body to move upward toward a water surface;

a tow cable connecting the towable body to the underwater vessel when the towable body is deployed away from the underwater vessel;

a keel and rudder extending from a bottom section of the towable body;

a receptacle formed in the underwater vessel, such that the bottom section including the keel and rudder is positionable therein; and an outer profile formed in a top section of the towable body substantially identical to an outer profile of the underwater vessel.

31. The system of claim 30, wherein the outer surface of the towable body is formed in a shape of a hydrofoil designed to maximize lift and minimize drag while moving through water, and where the hydrofoil has a lift to drag ratio greater than approximately 1.0.

32. The system of claim 30, wherein the receptacle formed in the outer profile of the vessel constructed to receive the bottom section of the towable body when the towable body is stowed on the underwater vessel; and wherein the outer profile of the top section of the towable body substantially conforms in shape and is substantially flush with adjacent portions of the outer profile of the underwater vessel when the towable body is stowed in the receptacle.

33. The system of claim 30, further comprising:

a pair of pontoons formed between the keel and the outer surface on opposing sides of the towable body.

34. The system of claim 33, wherein the pontoons provide stability to the towable body while floating on the water surface.

35. The system of claim 30, wherein the towable body is at least partially buoyant in water.

36. The system of claim 30 further comprising:

an underwater communication system including an antenna housed within the towable body being operable for relaying communication signals between the underwater vessel and an external communication system when the antenna is proximate the surface of the water.

37. The system of claim 36, wherein the underwater communication system cycles through available communication channels to determine an open channel and transmit data on the open communication channel.

38. The system of claim 36, wherein the communication system include at least one of a GPS communication system, a satellite communication system, a Wi-Fi communication system, and an RF communication system.

39. The system of claim 30, wherein the tow cable is a coax cable.

40. The system of claim 30, wherein the tow cable includes a fiber optic line.

41. The system of claim 30, wherein the tow cable transmits electric power and data signals between the underwater vessel and the towable body.

42. The system of claim 30, further comprising:

a launch and recovery system attachable to the underwater vessel and operable to spool out and retract the tow cable to launch and recover the towable body.

* * * * *